US006612384B1

(12) United States Patent
Singh et al.

(10) Patent No.: US 6,612,384 B1
(45) Date of Patent: Sep. 2, 2003

(54) CUTTING STRUCTURE FOR ROLLER CONE DRILL BITS

(75) Inventors: Amardeep Singh, Houston, TX (US); Ying Xiang, The Woodlands, TX (US); Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/590,577

(22) Filed: Jun. 8, 2000

(51) Int. Cl.[7] ..... E21B 10/16
(52) U.S. Cl. ..... 175/341; 175/331; 175/378
(58) Field of Search ..... 175/374, 426, 175/377, 378, 331, 341

(56) References Cited

U.S. PATENT DOCUMENTS

| | | | | | |
|---|---|---|---|---|---|
| 4,386,669 | A | * | 6/1983 | Evans | 175/269 |
| 4,408,671 | A | | 10/1983 | Munson | 175/377 |
| 4,444,281 | A | * | 4/1984 | Schumacher, Jr. et al. | 175/336 |
| 4,611,673 | A | | 9/1986 | Childers et al. | 175/340 |
| 4,657,093 | A | | 4/1987 | Schumacher | 175/353 |
| 4,848,476 | A | | 7/1989 | Deane et al. | 175/340 |
| 5,372,210 | A | | 12/1994 | Harrell | 175/431 |
| 5,394,952 | A | | 3/1995 | Johns et al. | 175/332 |
| 5,813,480 | A | | 9/1998 | Zaleski, Jr. et al. | 175/40 |
| 5,967,245 | A | * | 10/1999 | Garcia et al. | 175/374 |
| 6,057,784 | A | | 5/2000 | Schaaf et al. | 340/854.4 |
| 6,095,262 | A | | 8/2000 | Chen | 175/57 |
| 6,213,225 | B1 | * | 4/2001 | Chen | 175/57 |
| 6,401,839 | B1 | | 6/2002 | Chen | 175/57 |
| 6,412,577 | B1 | | 7/2002 | Chen | 175/57 |

FOREIGN PATENT DOCUMENTS

| | | | |
|---|---|---|---|
| GB | 2370059 A | 6/2002 | E21B/10/16 |
| WO | WO 00/12859 | 3/2000 | E12B/10/16 |
| WO | WO 00/12860 | 3/2000 | |

OTHER PUBLICATIONS

Great Britain Search Report dated Dec. 2, 2002 (1 page).
Great Britain Search Report dated Dec. 1, 2002 (1 page).
Ma Dekun et al., "The Operational Mechanics of the Rock Bit", Petroleum Industry Press, 1996, pp. 1–243.
Society of Petroleum Engineers Paper No. 29922, "The Computer Simulation of the Interaction Between Roller Bit and Rock," Dekun Ma, et al, presented Nov. 14–17, 1995, 9 pages.
Society of Petroleum Engineers Paper No. 56439, "Field Investigation of the Effects of Stick–Slip, Lateral, and Whirl Vibrations on Roller Cone Bit Performance," S.L. Chen et al., presented Oct. 3–6, 1999, 10 pages.
Society of Petroleum Engineers Paper No. 71053, "Development and Application of a New Roller Cone Bit with Optimized Tooth Orientation," S.L. Chen et al., presented May 21–23, 2001, 15 pages.
Society of Petroleum Engineers Paper No. 71393, "Development and Field Applications of Roller Cone Bit with Balanced Cutting Structure," S.L. Chen et al., presented Sep. 30–Oct. 3, 2001, 11 pages.
Great Britain Search Report dated Aug. 14, 2001, 5 pages.

* cited by examiner

*Primary Examiner*—David Bagnell
*Assistant Examiner*—Zakiya Walker
(74) *Attorney, Agent, or Firm*—Rosenthal & Osha L.L.P.

(57) ABSTRACT

New cutting structures for roller cone drill bits. In one aspect, a drill bit includes a bit body, roller cones attached to the bit body and able to rotate with respect to the bit body, and a plurality of cutting elements disposed on each of the roller cones, such that axial force on the bit during drilling is substantially balanced between the cones. In another aspect, a drill bit includes a plurality of cutting elements disposed on each roller cone such that the amount of work performed by each cone during drilling is substantially the same as the amount of work performed by each of the other cones. In yet another aspect, a drill bit includes a plurality of cutting elements disposed on each roller cone such that distribution of axial force on the bit is optimized.

111 Claims, 15 Drawing Sheets

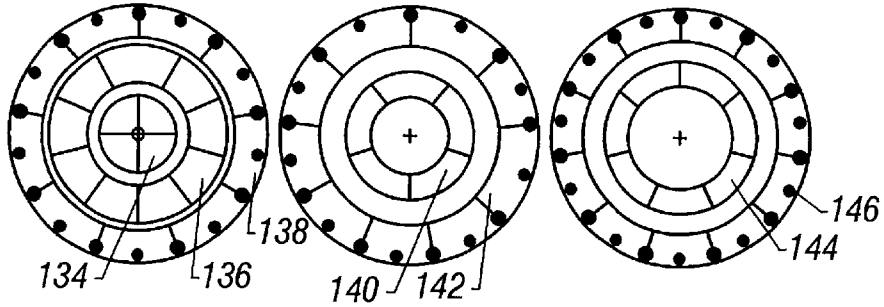

| | CONE | ROW | # TEETH | SPACING | INCLINATION ANGLE | TOOTH ANGLE | TOOTH WIDTH INNER END ② | TOOTH WIDTH OUTER END 3 | ROOT ANGLE | END MILL CUTTER ANGLE | END MILL CUTTER RADIUS | SPECIAL INSTRUCTIONS |
|---|---|---|---|---|---|---|---|---|---|---|---|---|
| 120 | | A | 4 | 4 | 19.49° | 40.00° | .06 | .06 | 16.69° | 120.00° | .125 R | SEE DIAGRAM FOR ORIENTATION |
| 122 | 1 | B | 9 | 19 | 31.89° | 43.00° | .09 | .09 | 18.33° | 75.00° | .250 R | ONE 1-1/2 P (SEE DIAGRAM FOR PLACEMENT) |
| 124 | | C | 9 | 18 | 11.99° | 43.00° | .14 | .14 | 10.53° | 62.50° | .125 R | DELETE EVERY OTHER TOOTH WITH 45° x .750 ED x .250 R CUTTER • 15.0° ROOT. MILL AXIS ⊥ TO TOOTH ROOT. STOP CUTTER PRIOR TO CONTACTING TEETH ON "B" ROW. |
| 126 | | A | 5 | 5 | 24.69° | 43.00° | .09 | .09 | 19.50° | 105.00° | .125 R | SEE DIAGRAM FOR ORIENTATION |
| 128 | 2 | B | 9 | 30 | 17.46° | 43.00° | .09 | .15 | 13.39° | 77.50° | .625 R / .375 R | THREE 1-1/3 P (SEE DIAGRAM FOR PLACEMENT) MILL FIRST PASS COMPLETELY THRU WITH .625 R CUTTER. MILL SECOND PASS WITH .375 R CUTTER AND STOP CUTTER PER PRINT. BLEND CUTS AS CLOSE AS POSSIBLE. |
| 130 | | A | 7 | 7 | 32.20° | 43.00° | .09 | .09 | 22.85° | 85.00° | .375 R | SEE DIAGRAM FOR ORIENTATION |
| 132 | 3 | B | 11 | 11 | 11.21° | 43.00° | .12 | .12 | 8.96° | 75.00° | .563 R / .250 R | MILL FIRST PASS COMPLETELY THRU WITH .563 R CUTTER. MILL SECOND PASS WITH .250 R CUTTER AND STOP CUTTER PER PRINT. BLEND CUTS AS CLOSE AS POSSIBLE. |

*FIG. 3C*
*(Prior Art)*

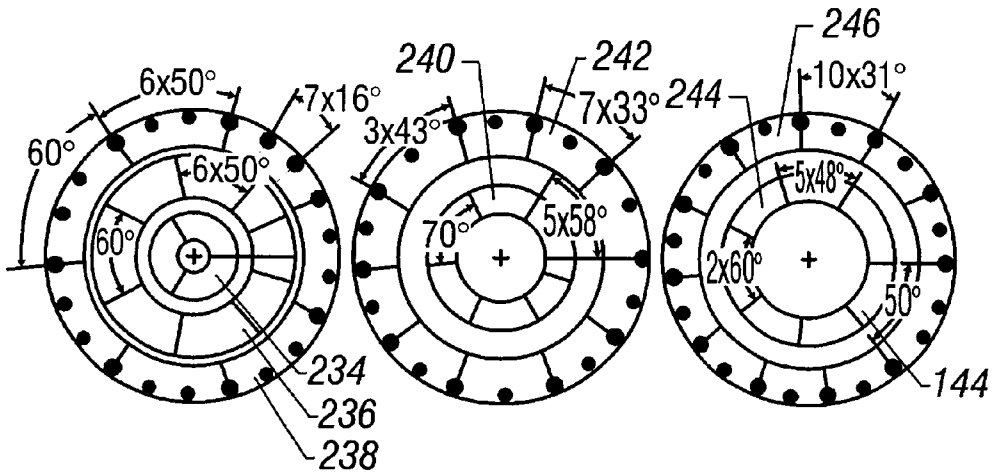

| | CONE | ROW | # TEETH | PITCH SPACING | TOOTH ANGLE | TOOTH WIDTH INNER END ② | TOOTH WIDTH OUTER END 3 | ROOT ANGLE | RADIUS | SPECIAL INSTRUCTIONS |
|---|---|---|---|---|---|---|---|---|---|---|
| 220 | | A | 3 | 3x120° | 43.00° | .09 | .09 | 16.69° | .125 R | SEE DIAGRAM FOR ORIENTATION |
| 222 | 1 | B | 7 | 6x50°;1x60° | 43.00° | .09 | .09 | 18.33° | .250 R | SEE DIAGRAM FOR ORIENTATION |
| 224 | | C | 7 | 6x50°;1x60° | 43.00° | .12 | .12 | 10.53° | .250 R | SEE DIAGRAM FOR ORIENTATION |
| 226 | | A | 6 | 5x58°;1x70° | 43.00° | .14 | .14 | 19.50° | .125 R | SEE DIAGRAM FOR ORIENTATION |
| 228 | 2 | B | 10 | 7x33°;3x43° | 43.00° | .12 | .12 | 13.39° | .188 R | SEE DIAGRAM FOR ORIENTATION |
| 230 | | A | 7 | 5x48°;2x60° | 43.00° | .09 | .09 | 22.85° | .188 R | SEE DIAGRAM FOR ORIENTATION |
| 232 | 3 | B | 11 | 10x31°;1x50° | 43.00° | .12 | .12 | 8.96° | .125 R | SEE DIAGRAM FOR ORIENTATION |

*FIG. 6*

CUTTING STRUCTURE FOR ROLLER CONE DRILL BITS

BACKGROUND OF THE INVENTION

1. Technical Field

The invention relates generally to roller cone drill bits for drilling earth formations, and more specifically to roller cone drill bit designs.

2. Background Art

Roller cone drill bits and fixed cutter bits are commonly used in the oil and gas industry for drilling wells. FIG. 1 shows one example of a roller cone drill bit used in a conventional drilling system for drilling a well bore in an earth formation. The drilling system includes a drilling rig 10 used to turn a drill string 12 which extends downward into the well bore 14. Connected to the end of the drill string 12 is a roller cone-type drill bit 20, shown in further detail in FIG. 2.

Referring to FIG. 2, roller cone drill bits 20 typically comprise a bit body 22 having an externally threaded connection at one end 24, and a plurality of roller cones 26 (usually three as shown) attached at the other end of the bit body 22. The cones 26 are able to rotate with respect to the bit body 22. Disposed on each of the cones 26 of the bit 20 is a plurality of cutting elements 28 typically arranged in rows about the surface of each cone 26.

The cutting elements 28 on a roller cone 26 may include primary cutting elements, gage cutting elements, and ridge cutting elements. Primary cutting elements are the cutting elements arranged on the surface of the cone such that they contact the bottomhole surface as the bit is rotated to cut through the formation. Gage cutting elements are the cutting elements arranged on the surface of the cone to scrape the side wall of the hole to maintain a desired diameter of the hole as the formation is drilled. Ridge cutting elements are miniature cutting elements typically located between primary cutting elements to cut formation ridges that may pass between the primary cutting elements to protect the cones and minimize wear on the cones due to contact with the formation. The cutting elements 28 may be tungsten carbide inserts, superhard inserts, such as polycrystalline diamond compacts, or milled steel teeth with or without hardface coating.

Significant expense is involved in the design and manufacture of drill bits to produce bits which have increased drilling efficiency and longevity. For more simple bit designs, such as those for fixed cutter bits, models have been developed and used to design and analyze bit configurations which exhibit balanced forces on the cutting elements of the bit during drilling. Fixed cutter bits designed using these models have been shown to provide faster penetration and long life.

Roller cone bits are more complex than fixed cutter bits, in that the cutting surfaces of the bit are disposed on roller cones, wherein each roller cone independently rotates relative to the rotation of the bit body about an axis oblique to the axis of the bit body. Because the cones rotate independently of each other, the rotational speed of each cone of the bit can be different from the rotation speed of the other cones. The rotation speed for each cone of a bit can be determined from the rotational speed of the bit and the effective radius of the "drive row" of the cone. The effective radius of the drive row is generally related to the radial extent of the cutting elements that extend axially the farthest from the axis of rotation of the cone, these cutting elements generally being located on a so-called "drive row". Adding to the complexity of roller cone bit designs, the cutting elements disposed on the cones of the roller cone bit deform the earth formation by a combination of compressive fracturing and shearing. Additionally, most modem roller cone bit designs have cutting elements arranged on each cone so that cutting elements on adjacent cones intermesh between the adjacent cones, as shown for example in FIG. 3A and further detailed in U.S. Pat. No. 5,372,210 issued to Harrell. Intermeshing of the cutting elements on roller cone bits is desirable to enable high insert protrusion to achieve good rates of penetration while preserving the longevity of the bit. However, intermeshing cutting elements on roller cone bits substantially constrains cutting element layout on the bit, thereby further complicating the designing of roller cone drill bits.

Because of the complexity of roller cone bit designs, accurate models of roller cone bits have not been widely developed or used to design roller cone bits. Instead, roller cone bits have largely been developed through trial and error. For example, if cutting elements on one cone of a prior art bit wore down faster that the cutting elements on another cone of the bit, a new bit design would be developed by simply adding more cutting elements to the faster worn cone in hopes of reducing the wear of each cutting element on that cone. Trial and error methods for designing roller cone bits have led to roller cone bits which have an imbalanced distribution of force on the bit. This is especially true for roller cone bits having cutting elements arranged to intermesh between adjacent cones.

Using a method for simulating the drilling performance of roller cone bits drilling earth formations, described in a U.S. patent application filed Ser. No. 09/524,088 in the United States on Mar. 13, 2000, entitled "Method for Simulating the Drilling of Roller Cone Drill Bits and its Application to Roller Cone Drill Bit Design and Performance" and assigned to the assignee of this invention, prior art roller cone bits were analyzed and found to typically unequally distribute the axial force on the bit between the cones, such that the axial forces on two cones differ by more than 200%. Such an unequal distribution of force between the cones results in an unequal distribution of stress, strain, wear, and premature failure of the cone or cones carrying the largest load(s) during drilling. Additionally, prior art roller cone bits typically have significant imbalances in the distribution of the volume of formation cut between the cones. In such prior art bits, the volume of formation cut by each cone, typically, differs by more than 75%, wherein the volume cut by one cone was 75% more than the volume of formation cut by each of the other cones on the bit. Prior art bits also have substantial imbalance between the amount of work performed by each of the cones on the bit.

Additionally, prior art bits with cutting elements arranged to intermesh between adjacent cones have significant differences in the number of cutting elements on each cone in contact with the formation during drilling. Prior art bits also typically have large differences in the projected area of cutting elements in contact with formation on each cone, and in the depths of penetration achieved by the cutting elements on each cone. As a result, the projection area of cutting element contact for each cone greatly differs in typical prior art bit designs. Additionally, the cutting elements on each cone of prior art bits typically achieve unequal depths of penetration for each cone. In some prior art designs, the unequal cutting element penetration depth between the cones is partially due to the bottomhole profile formed by the bit during drilling. Additionally for typical prior art bits, the axial force on the bit is distributed in a multi modal profile and the forces on corresponding rows of each cone may significantly differ. Further, prior art bits often have cutting elements arranged about the surface of each cone such that forces acting on corresponding cutting elements on each cone significantly differ. Using drill bits which have multi-modal force distributions, or an unequal distribution of force between corresponding rows of the cones or corresponding cutting elements of the cones may result in a bottomhole profile formed by the bit that is multi-modal which may contribute to the unequal cutting element penetration depth and an imbalanced distribution of force on the bit between the cones.

One example of a prior art bit considered effective in the drilling wells is shown in FIGS. 3A–3D. This drill bit comprises a bit body 100 and three roller cones 110 attached thereto, such that each roller cone 110 is able to rotate with respect to the bit body 100 about an axis oblique to the bit body 100. Disposed on each of the cones 110 is a plurality of cutting elements 112 for cutting into an earth formation. The cutting elements are arranged about the surface of each cone in generally circular, concentric rows substantially concentric with the axis of rotation of the respective cone, as illustrated in FIG. 3C. In FIG. 3A, the profiles of each row of cutting elements on each cone are shown in relation to each other to show the intermeshing of the cutting elements between adjacent cones. In this example, the cutting elements comprise milled steel teeth with hardface coating applied thereon. This type of drill bit is commonly referred to as a "milled tooth" bit.

As is typical for milled tooth roller cone bits, the teeth are arranged in three rows 114*a*, 114*b*, and 114*c* on the first cone 114, two rows 116*a* and 116*b* on the second cone 116, and two rows 118*a* and 118*b* on the third cone 118. At least one row of teeth on each cone is arranged to intermesh with a row of teeth on an adjacent cone. The first row 114*a* of the first cone 114 is located at the apex of the cone and is typically referred to as the spearpoint of the bit.

The drilling performance of this prior art bit was simulated and analyzed using the method described in the previously referred to U.S. patent application Ser. No. 09/524,088 (filed in the United States on Mar. 13, 2000, entitled "Method for Simulating the Drilling of Roller Cone Drill Bits and its Application to Roller Cone Drill Bit Design and Performance" and assigned to the assignee of this invention). From this analysis, it was found that the prior art bit has unbalanced axial force between the cones, wherein the axial force on the bit during drilling was distributed between the first 114, second 116, and third 118 cones in the ratio of 2.91:1.67:1, respectively. Thus, the axial force on the first cone during drilling, on average, was approximately three times the axial force on the third cone. Additionally, this prior art bit was found to exhibit rock cutting volume ratios for the first 114, second 116 and third 118 cones of 1.84:1.03:1, respectively, wherein the first cone 114 was found to cut over 80% more rock than the third cone 118.

In designing roller cone bits, ideally the cutting elements are disposed on the bit such that the same number of cutting elements on each cone contacts the formation at each point in time throughout drilling. However, in practical bits, the number of cutting elements on each cone which contacts the formation differs at each point in time throughout drilling. For example, at one instant in time a cone may have three cutting elements in contact with a formation. At another instant in time the same cone may have two cutting elements in contact with the formation. At a third instant in time the cone may have four cutting elements in contact with the formation. Therefore, in order to determine whether the number of cutting elements on the bit contacting a formation is equally distributed between the cones, the fraction of the total time that each number of cutting elements on each cone instantaneously contacts the formation must be compared. In an analysis of typical tri-cone prior art bits, it was found that the distribution of the time a number of cutting elements on each cone contacts a formation during drilling significantly differed for each cone.

One example of a distribution of contact for a prior art bit is shown in FIGS. 8A–8D. The drill bit in this example was a tri-cone bit with milled steel teeth, similar to the drill bit shown in FIGS. 3A–3D. FIG. 8A shows a distribution of the time that each of a number of cutting elements contacts the earth formation during drilling for the entire bit. FIGS. 8B–8C each show a distribution of the time that each of a number of cutting elements on each cone contacts the earth formation during drilling . From FIGS. 8A–8C, it can be observed that the distributions of contact for each cone are significantly different. For example, the second cone has two or fewer cutting elements in contact with the formation the majority of the time, while the first and third cones have three or more cutting elements in contact the majority of the time. In particular, the first, second and third cones have three or more cutting elements in contact with the formation 70%, 45%, and 55% of the time, respectively. Thus, the contribution of each cone significantly differs. Further, it can be seen that the greatest difference between the fraction of time a given number of cutting elements on each cone contacts the earth formation during drilling is approximately 27%, wherein the first cone has two cutting elements in contact with the formation approximately 16% of the time, while the second cone has two cutting elements in contact with the formation approximately 43% of the time. Additionally, it can be determined from these distributions that the first cone has an average of about 3.3 cutting elements in contact with the formation during drilling, while the second and third cones average about 2.35 and 2.52 cutting elements in contact during drilling, respectively. Thus, the contribution of the first cone to the number of cutting elements in contact with the formation is greater than the contribution of each of the other two cones. The largest difference in the average number of cutting elements in contact with the formation between cones is approximately 0.95 cutting elements. Thus, on average, the first cone has one more cutting element in contact with the formation during drilling than the second cone, and almost one more cutting element in contact than cone three. While this average difference in the number of cutting elements contacting the formation is only one cutting element, such an imbalance in the distribution of contact between the cones, may result in an imbalanced distribution of force, stress, strain, and wear between the cones, which may lead to the premature failure of the bit. Thus, it is desirable to design a bit having intermeshing cutting elements between the cones, wherein the average number of cutting elements contacting the formation is substantially the same for each cone, so that wear on the bit is more equally distributed between the cones, potentially increasing the effectiveness and longevity of the cones and the bit.

BRIEF SUMMARY OF THE INVENTION

In one aspect, the invention comprises a roller cone drill bit for drilling an earth formation. The drill bit includes a bit body, and three roller cones attached to the bit body and able to rotate with respect to the bit body. The bit further includes a plurality of cutting elements disposed on each of the cones, such that axial force on the bit during drilling is substantially balanced between the cones.

In another aspect, the invention comprises a roller cone drill bit for drilling an earth formation. The drill bit includes a bit body, and three roller cones attached to the bit body and able to rotate with respect to the bit body. The bit further includes a plurality of cutting elements disposed on each of the cones, such that an amount of work performed by each cone during drilling is substantially the same as that of the other cones.

In another aspect, the invention comprises a roller cone drill bit for drilling an earth formation. The drill bit includes a bit body, and three roller cones attached to the bit body and able to rotate with respect to the bit body. The bit further includes a plurality of cutting elements disposed on each of the cones, such that a distribution of time that each of a number of cutting elements on each cone contacts a formation during drilling is substantially the same for each of the cones.

In another aspect, the invention comprises a roller cone drill bit for drilling an earth formation. The drill bit includes a bit body, and three roller cones attached to the bit body and able to rotate with respect to the bit body. The bit further includes a plurality of cutting elements disposed on each of the cones, such that a projected area of cutting elements in contact with a formation during drilling is substantially the same for each of the cones.

In another aspect, the invention comprises a roller cone drill bit for drilling an earth formation. The drill bit includes a bit body, and three roller cones attached to the bit body and able to rotate with respect to the bit body. The bit further includes a plurality of cutting elements disposed on each of the cones, such that a depth of penetration for each cutting element into a formation during drilling is substantially the same for each of the cones.

In another aspect, the invention comprises a roller cone drill bit for drilling an earth formation. The drill bit includes a bit body, and three roller cones attached to the bit body and able to rotate with respect to the bit body. The bit further includes a plurality of cutting elements disposed on each of the cones, such that a distribution of axial force on the bit is optimized.

BRIEF DESCRIPTION OF THE DRAWINGS

FIG. 3C is a spacing diagram for a prior art bit.

FIG. 6 is a spacing diagram for a drill bit in accordance with one embodiment of the invention.

FIG. 8A shows the distribution for the entire bit. FIGS. 8B–8D shows the distribution for each of the cones.

FIG. 9A shows the distribution for the entire bit. FIGS. 9B–9D show the distribution for each of the cones.

DETAILED DESCRIPTION

Figure 1:
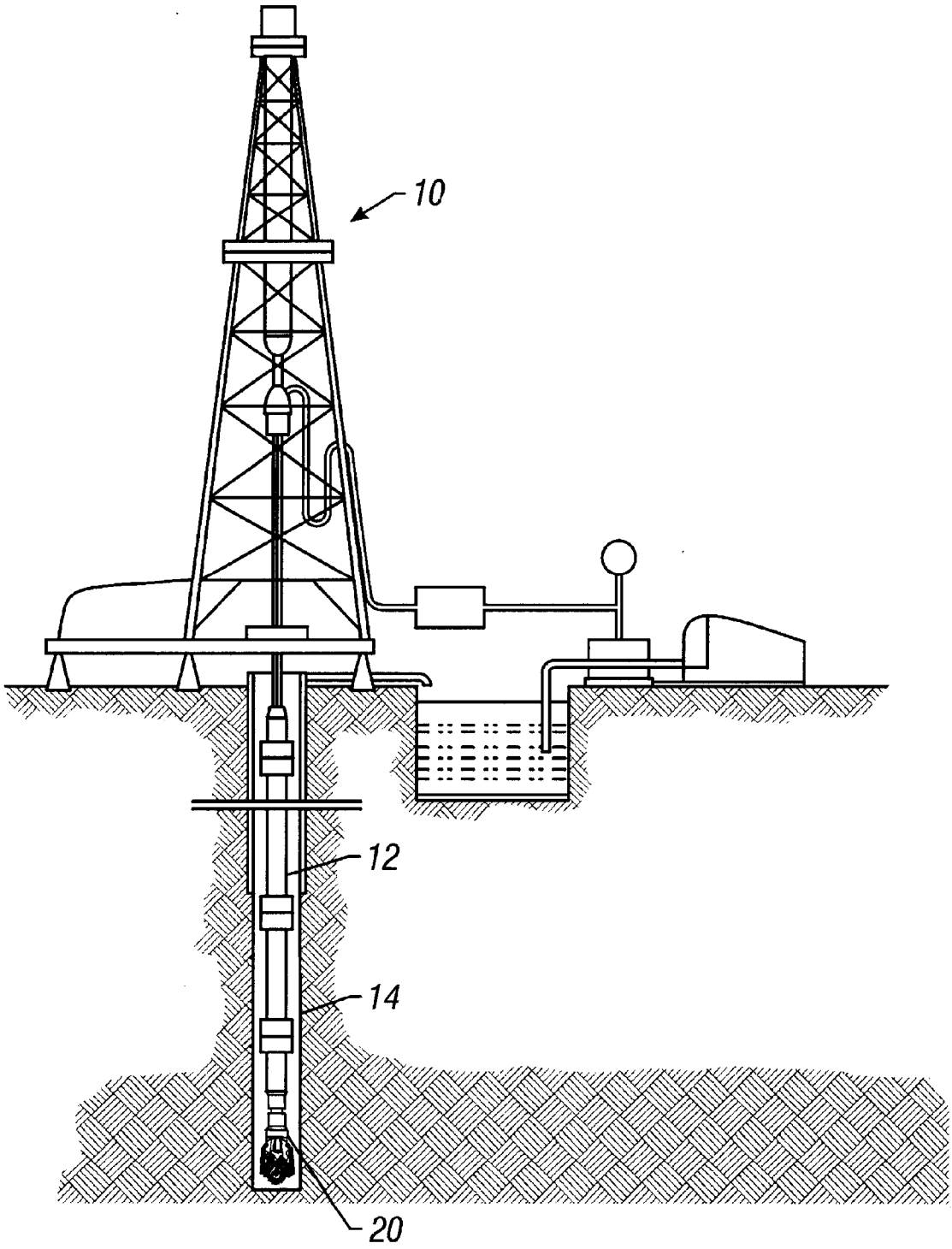
FIG. 1 (Prior Art)
FIG. 1 shows a schematic diagram of a drilling system for drilling earth formations.
Figure 2:
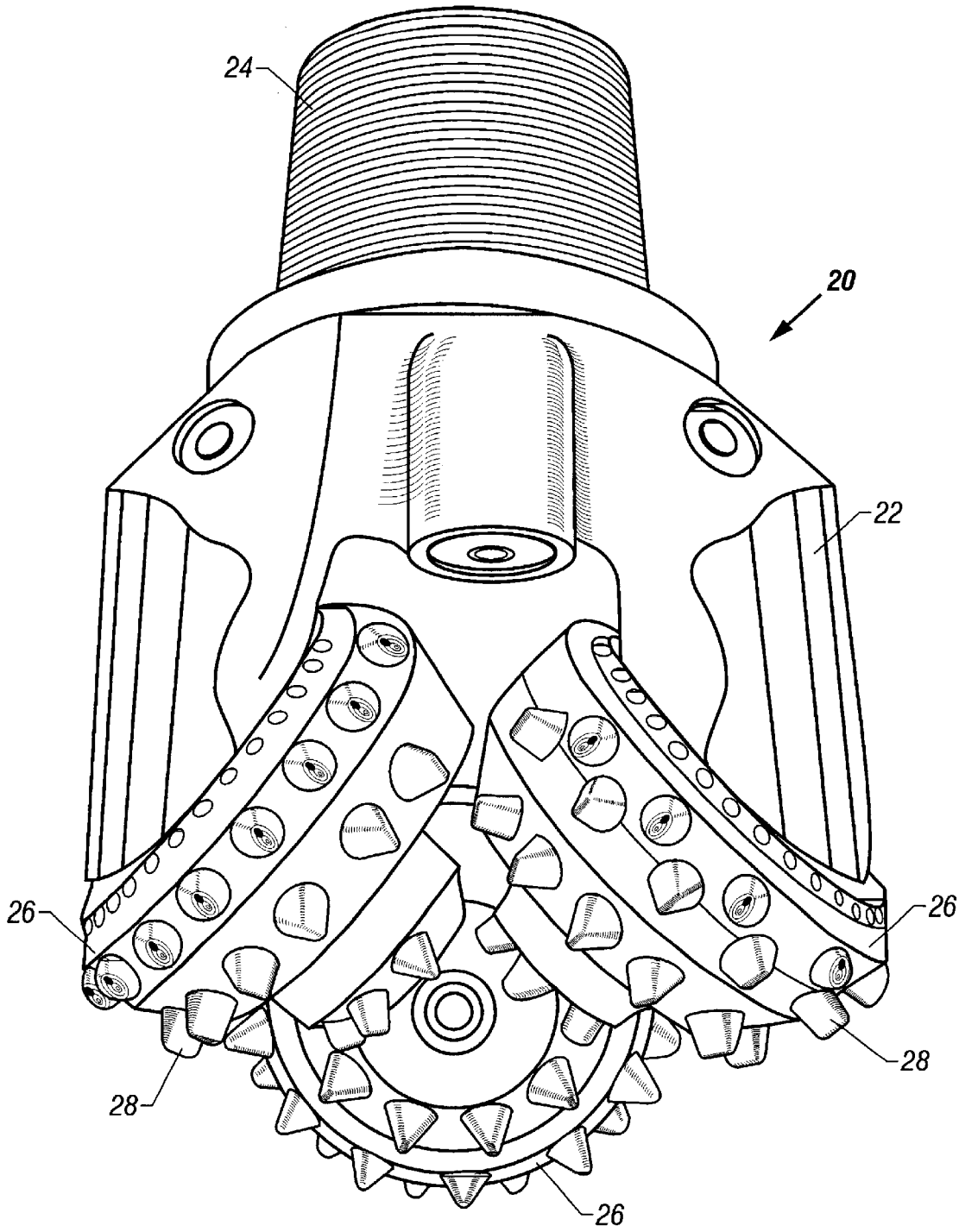
FIG. 2 (Prior Art)
FIG. 2 shows a perspective view of a prior art roller cone drill bit.
Figure 3B:
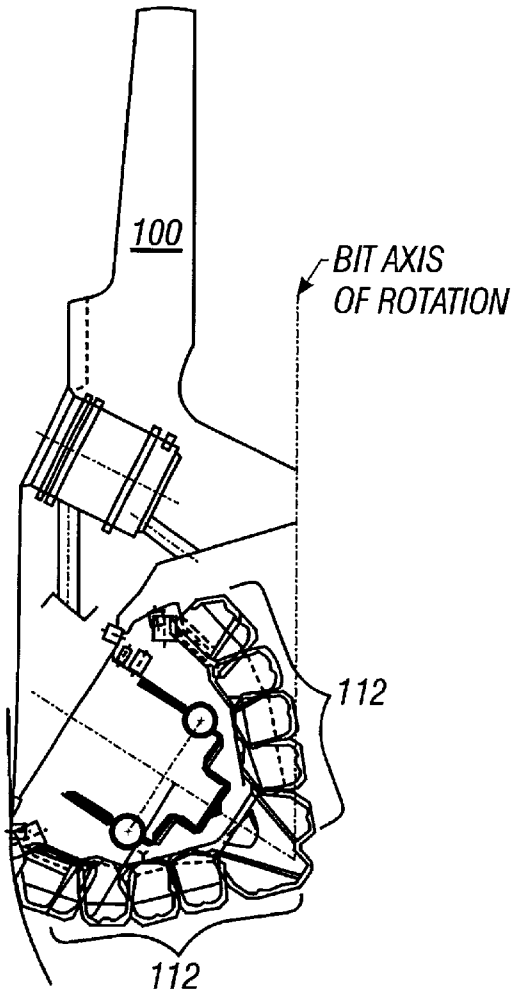
FIG. 3B (Prior Art)
FIG. 3B is a schematic diagram of one leg of a prior art bit wherein the effective position of cutting elements on all three cones of the bit are illustrated on the cone shown to illustrate bottomhole coverage of the bit.
Figure 3A:
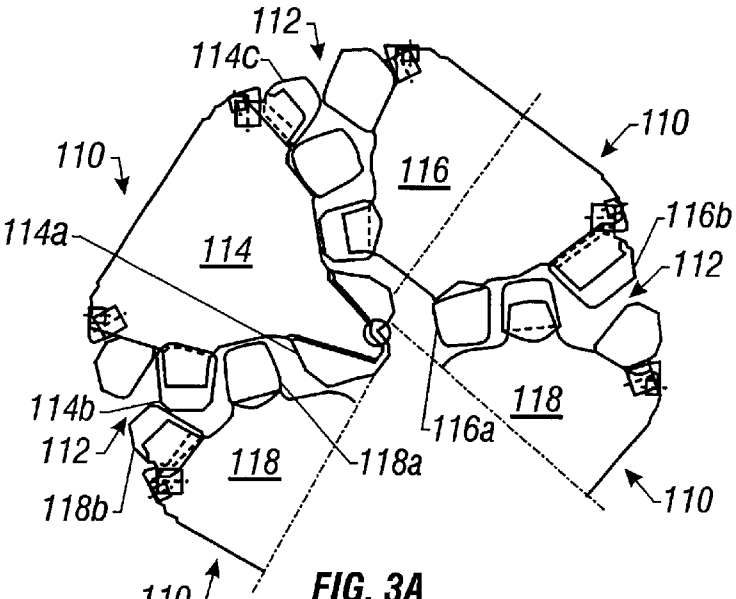
FIG. 3A (Prior Art)
FIG. 3A is a diagram of the roller cones of a prior art drill bit illustrating the intermeshing relationship of the cutting elements between the cones.
Figure 3D:
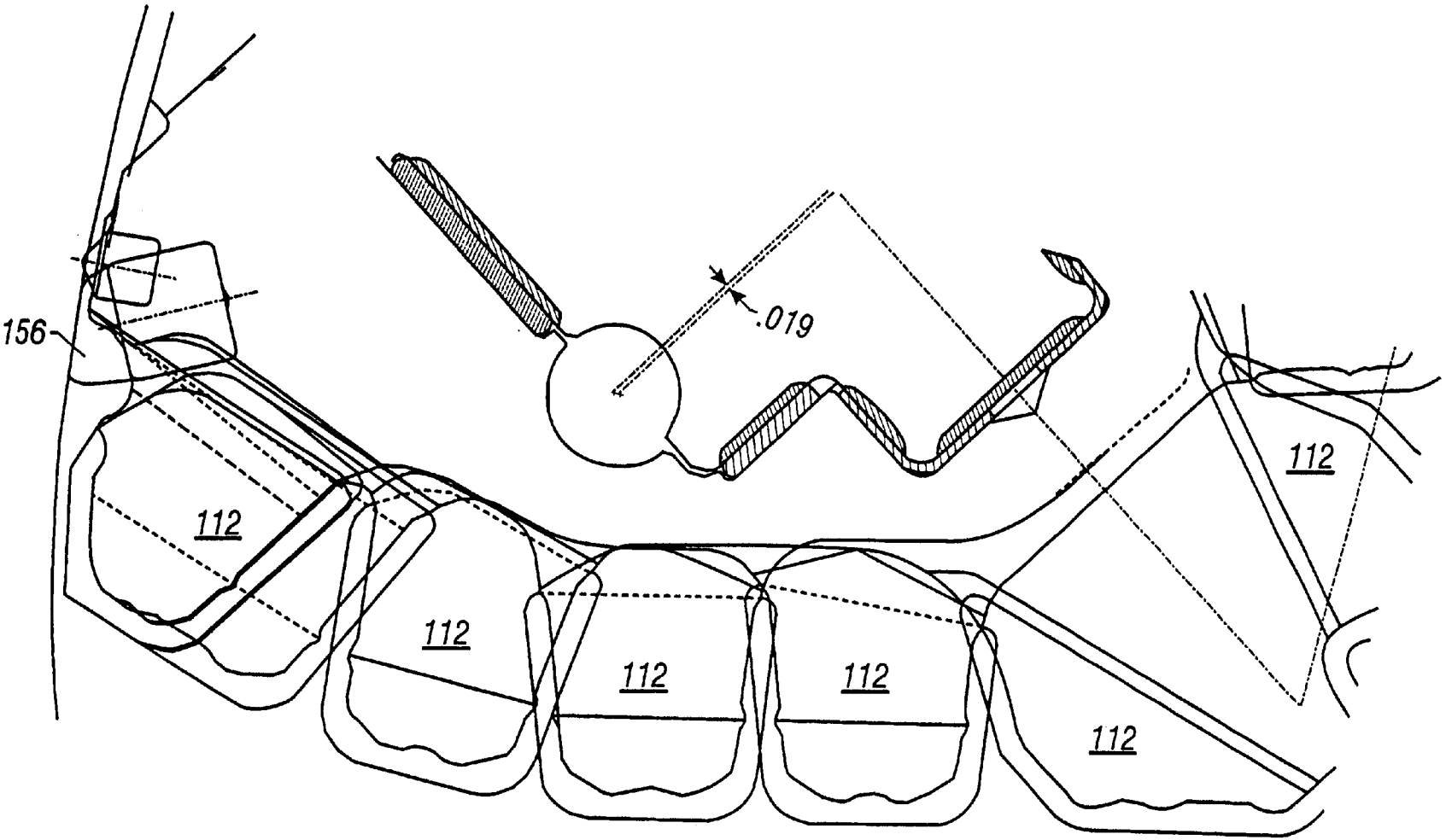
FIG. 3D (Prior Art)
FIG. 3D is an enlarged partial view of the cone and cutting elements of the prior art bit shown in FIG. 3B.
Figure 5:
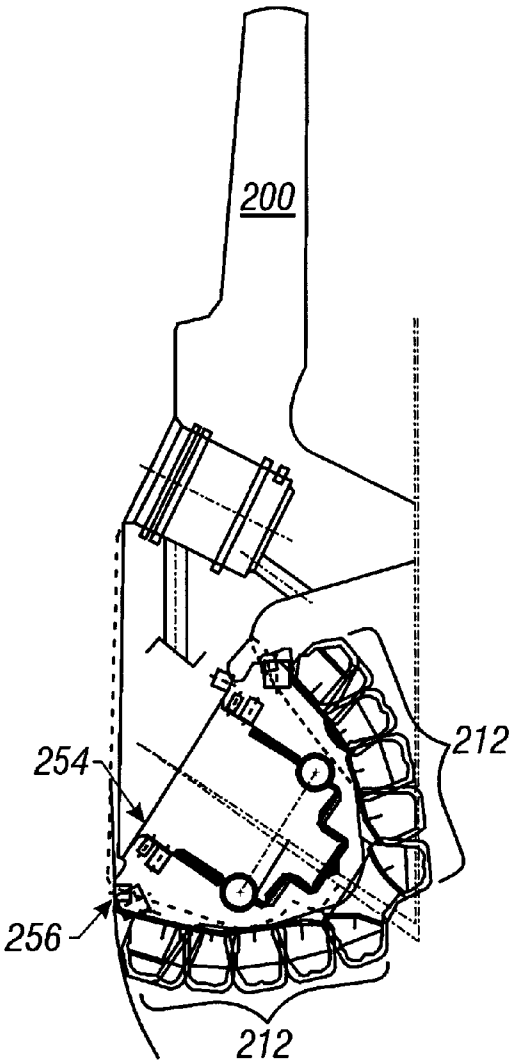
FIG. 5 is a schematic diagram of one leg of a drill bit configured in accordance with one embodiment of the present invention, wherein the effective position of cutting elements on all three cones of the bit are illustrated on the cone shown to illustrate bottomhole coverage of the bit.
Figure 4:
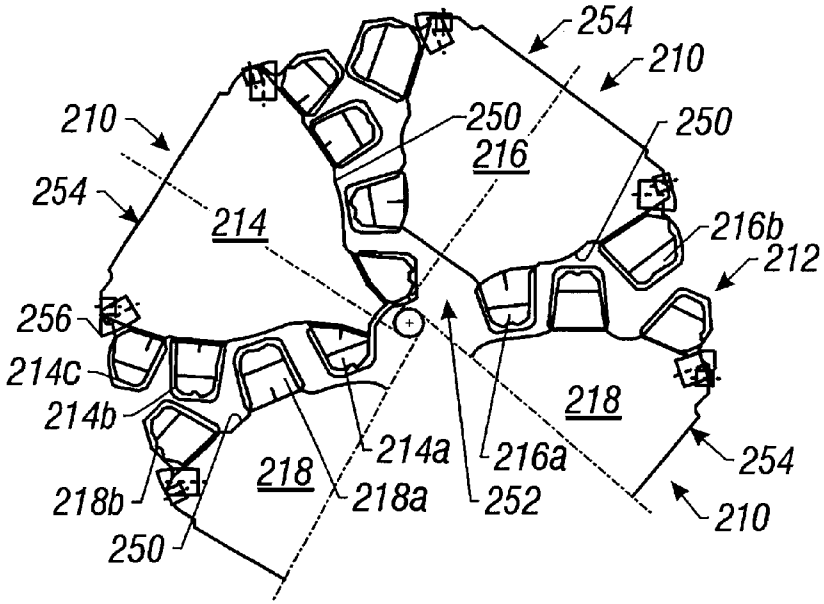
FIG. 4 is a diagram of the roller cones for a bit in accordance with one embodiment of the invention illustrating an intermeshing relationship of the cutting elements between the cones.
Figure 7:
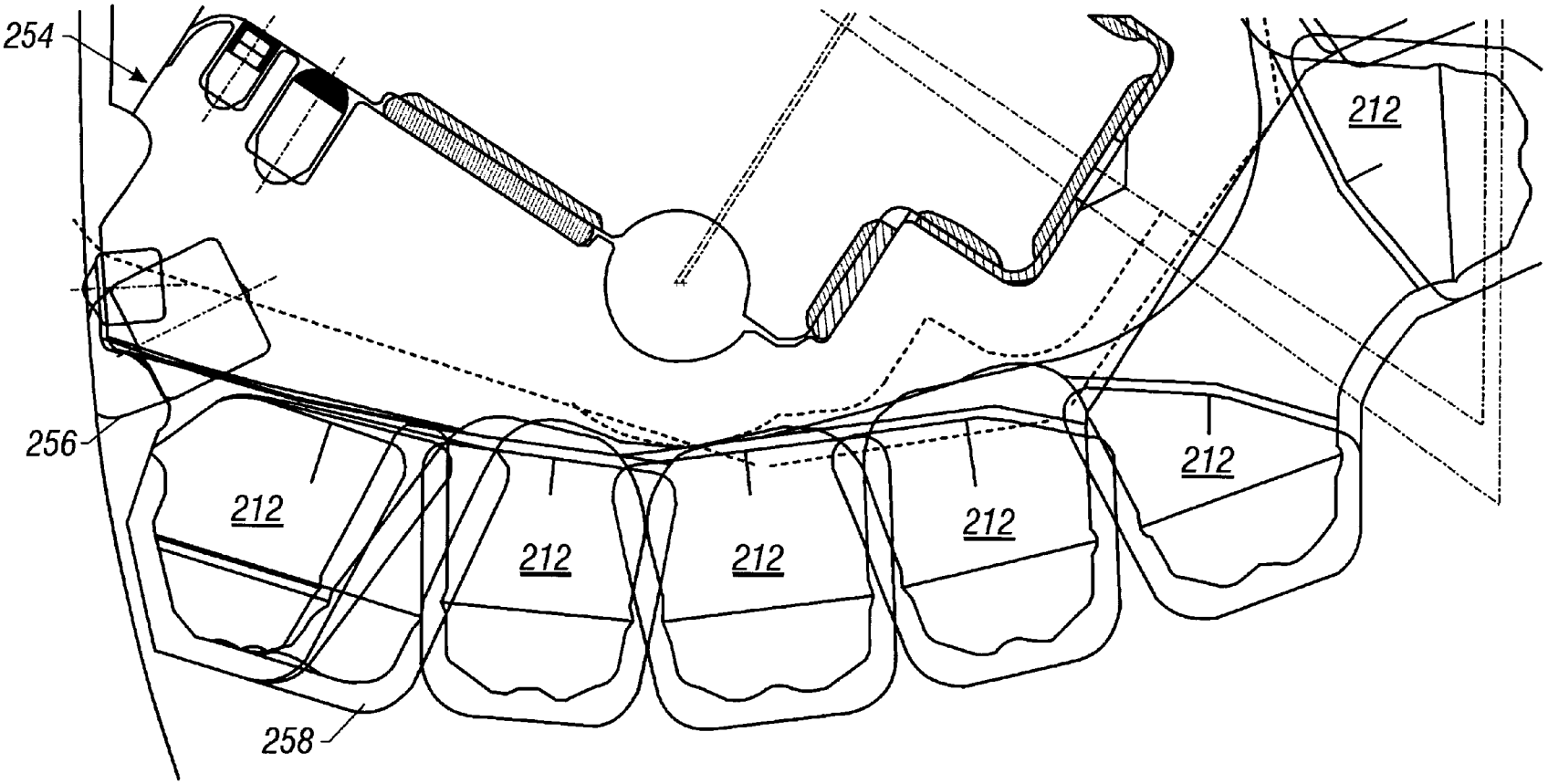
FIG. 7 is an enlarged partial view of the cones and cutting elements for an embodiment of the invention as shown in FIG. 5.

Referring to FIGS. 4–7, in one embodiment, the invention comprises a roller cone drill bit which includes a bit body 200 (partial view in FIG. 5) and a plurality of roller cones (typically three), shown generally at 210 in FIG. 4. The roller cones 210 are attached to the bit body 200 and rotatable with respect to the bit body 200. In this embodiment, the cones 210 include a first cone 214, a second cone 216, and a third cone 218. Each cone 214, 216, 218 includes an exterior surface, generally conical in shape, having a side surface 250. Disposed about the side surface 250 of each cone 210 is a plurality of cutting elements, shown generally at 212 and additionally at 256. A distinction between cutting elements 212 and cutting elements 256 will be further explained.

The plurality of cutting elements disposed on each cone are arranged primarily on the side surface 250 of each cone 214, 216, 218, as shown in FIG. 4. In general terms, at least three different types of cutting elements may be disposed on the cones, including primary cutting elements, generally indicated as 212, gage cutting elements, generally indicated as 256 and ridge cutting elements (not shown). In the embodiment of FIG. 4, primary cutting elements 212 are the cutting elements generally arranged about the side surface 250 of the cones and used as the primary means for cutting through the bottomhole surface of the earth formation. Primary cutting elements 212 are arranged on each cone such that cutting elements on adjacent cones intermesh between the cones. Gage cutting elements 256 are cutting elements which scrape the wall of the well bore to maintain the diameter of the well bore. Gage cutting elements 256 are typically arranged in one or more rows, often referred to as "gage" rows, "heel" rows, or "trucut" rows, about the lower edge of one or more cones as shown at 256 in FIGS. 4, 5, and 7. Ridge cutting elements (not shown) are miniature cutting elements, typically comprising hardened material deposits, that are optionally disposed about the surface of the cone, usually between primary cutting elements 212 to cut ridges of formation which pass between primary cutting elements 212 on the cones. Ridge cutting elements (not shown) are used to reduce damage or wear of the cone surface by reducing contact between the cone surface and the formation ridges.

It should be understood that in a drill bit according to the invention, the cutting elements may comprise only primary cutting elements 212, or primary cutting elements 212, gage cutting elements 256 and, optionally, ridge cutting elements (not shown). Further, while primary cutting elements 212 and gage cutting elements 256 are shown as distinctly different sets of cutting elements in this embodiment, it should be understood that in other embodiments, one or more primary cutting elements 212 may be disposed on one or more cones to essentially perform as a gage cutting element. The types and combinations of cutting elements used in specific embodiments of the invention are matters of choice for the bit designer and are not intended as limitations on the invention. Further, it should be understood that all cutting elements between adjacent cones may not necessarily intermesh. The number of cutting elements and the arrangement of cutting elements that intermesh between adjacent cones are also matters of choice for the bit designer.

FIG. 4 shows the cone and cutting element configurations for this embodiment of the invention illustrating the location of the primary cutting elements 212 on each cone. In this embodiment, the primary cutting elements 212 on each cone are arranged such that primary cutting elements 212 on adjacent cones intermesh between the cones, as shown in FIG. 4.

In this embodiment, the cutting elements comprise "teeth" such as milled steel teeth, but it should be understood that the invention is not limited to so called "milled tooth" drill bits. Other cutting elements such as tungsten carbide inserts or polycrystalline diamond compacts may, alternatively, be used in accordance with the invention. In this embodiment, the primary cutting elements 212 are generally arranged in circular, concentric rows about the side surface 250 of each cone, as shown in FIGS. 4 and 6 as previously explained. On the first cone 214 the cutting elements 212 are arranged in three rows 214*a*, 214*b* and 214*c*. On the second cone 216 the cutting elements 212 are arranged in two rows 216*a* and 216*b*. On the third cone 218 the cutting elements 212 are arranged in two rows, 218*a* and 218*b*. The cutting elements are arranged so that at least one row of cutting elements on each cone intermeshes with a row of cutting elements on an adjacent cone.

In this exemplary embodiment, the primary cutting elements 212, as previously explained, comprise milled steel teeth formed on the cones. Hardface coating 258 is applied to the teeth (shown in more detail in FIG. 7) to produce a tooth cutting structure with increased hardness. In alternative embodiments, the cutting elements may comprise milled steel teeth without hardface coating, or alternatively, tungsten carbide insert, superhard inserts, such as boron nitride or polycrystalline diamond compacts, or inserts with other hard coatings or superhard coatings applied there on, as determined by the bit designer. It should also be understood that the number of the cutting elements shown in FIG. 6 is directed to the number of the primary cutting elements disposed on the cutters to cut the bottomhole surface of the well bore. The number and arrangement of gage cutting elements, in this embodiment is a matter of convenience for the bit designer. Additionally, ridge cutting elements may, optionally, be disposed on the cone body as determined by the bit designer.

Using a method for simulating the drilling performance of roller cone bits drilling earth formation, such as the method described in the previously referred to U.S. patent application Ser. No. 09/524,088 (filed in the United States on Mar. 13, 2000, entitled "Method for Simulating the Drilling of Roller Cone Drill Bits and its Application to Roller Cone Drill Bit Design and Performance" and assigned to the assignee of this invention), for example, the drilling performance of a bit in accordance with this embodiment was analyzed and found to have several characteristics which represent improvements over prior art roller cone drill bits.

Advantageously, the roller cone bit in accordance with the embodiment of FIGS. 4–7 provides substantially balanced axial force between the cones during drilling. Specifically, analysis showed that the ratio of force on each cone normalized with respect to the smallest force on a cone for cones 1, 2, and 3 was about 1.09:1:1.03, respectively. Therefore, axial force was balanced to within about 10%. Prior art bit designs were found to have axial force imbalances of well over 200% between the cones. For example, a simulation of the drilling performance of the prior art bit shown in FIGS. 3A–3D and discussed above found force balance ratios between the cones of 2.91:1.67:1. Such a large imbalance of forces on the cones can lead to increased stress, strain, and ultimately wear of the cone carrying the majority of the of the axial load. A large imbalance of axial force between the cones also suggests a large imbalance of drilling contribution of each cone, as determined by analysis of prior art bits. By more evenly distributing the loads and work of each cone of the bit, the bearing wear can be more evenly balanced, and the rate of penetration and the life of the bit may be increased.

Advantageously, this embodiment of the invention shows substantially balanced rock (formation) volume cutting between the cones. Balanced rock volume cutting between cones is desirable because it allows the cutting contribution of each cone to be equalized, thereby equalizing the force distribution on the cones and reducing the unequal wear on the cones. This potentially increases the longevity of the bit. For this embodiment, the ratio of rock volume cut by each of the cones is 1.02:1:1.08, normalized with respect to the smallest volume cut by any one cone. Thus, this embodiment exhibits a maximum rock cut volume difference between cones of approximately 8%. This is a significant improvement over the distribution of rock volume cut between the cones prior art roller cone bits. Prior art milled tooth bits, for example, have maximum rock cut volume difference between cones of approximately 75% or more. For example, the ratio of rock volume cut by each of the cones of the prior art bit in FIGS. 3A–3D was found to be 1.84:1.03:1. Accordingly, the embodiment of the invention as shown in FIGS. 4–7, provides a significant improvement in equalizing the volume of formation cut by each cone.

Advantageously, this embodiment provides a more balanced distribution of instantaneous cutting element contact with the formation between the cones. Additionally, the projected area of cutting elements in contact with the formation being drilled is substantially the same for each cone of the bit. Further, in this embodiment, the cutting elements are disposed about the surface of each cone such that the penetration depth for cutting elements on each cone is substantially the same for each of the cones.

In this embodiment of the invention, the cutting elements are arranged in rows on the side surface of each cone as previously described. In alternative embodiments of the invention, cutting elements may be arranged in any number of rows on each of the cones, or the cutting elements may not be arranged in rows, but instead placed in a different configuration about the surface of the cone, such as a staggered arrangement. It should be understood that the invention is not limited to the particular arrangement of the cutting elements shown in FIGS. 4–7, but rather the cutting elements may be arranged in any suitable manner as determined by the bit designer without departing from the spirit of the invention. Further, although a roller cone bit having three cones is shown for this embodiment, it should be understood that the invention is not limited to bits having three roller cones. Rather, the invention only requires that the bit have at least three cones. Additionally, although all of the advantages noted above are realized in this particular embodiment of the invention, it should be understood that other embodiments of the invention exist which may not include each and every one of the advantages described for this embodiment. Thus, the invention is not limited to embodiments which include all of the advantages shown in the foregoing embodiment. Other embodiments may exist as further described.

Axial Forces Substantially Balanced Between Cones

In another aspect, the invention comprises a roller cone bit having a bit body and a plurality of roller cones attached to the bit body and able to rotate with respect to the bit body. The bit further includes a plurality of cutting elements arranged on each cone so that cutting elements on adjacent cones intermesh between the cones; the cutting elements being arranged such that the total axial force exerted on the bit during drilling is substantially balanced between the cones.

In one embodiment of this aspect, the cutting elements are disposed each cone of the bit so that force difference between any two cones is less than about 25%. In a more preferred embodiment, the cutting elements are arranged so that a force difference between any two cones is less than about 10%.

One method for determining the balance of axial force between the cones is disclosed in the previously referred to U.S. patent application Ser. No. 09/524,088 (filed in the United States on Mar. 13, 2000, entitled "Method for Simulating the Drilling of Roller Cone Drill Bits and its Application to Roller Cone Drill Bit Design and Performance") which is incorporated herein by reference. This method comprises selecting bit design parameters, selecting drilling parameters, selecting the earth formation to be drilled, and calculating from the selected parameters and formation, parameters for individual craters formed when cutting elements on each cone contact the earth formation. From the crater parameter calculations, the bottom hole geometry can then be calculated. The method further includes repeating these calculations for incremental rotations of the drill bit to obtain a visual representation of the drilling performance of the selected bit. Using this method, the force on each cone of the bit during drilling can be calculated and compared to determine the distribution of axial force between the cones during drilling. Additionally, this method can be used to test different cutting element configurations to find configurations which are substantially force-balanced.

Figure 8A:
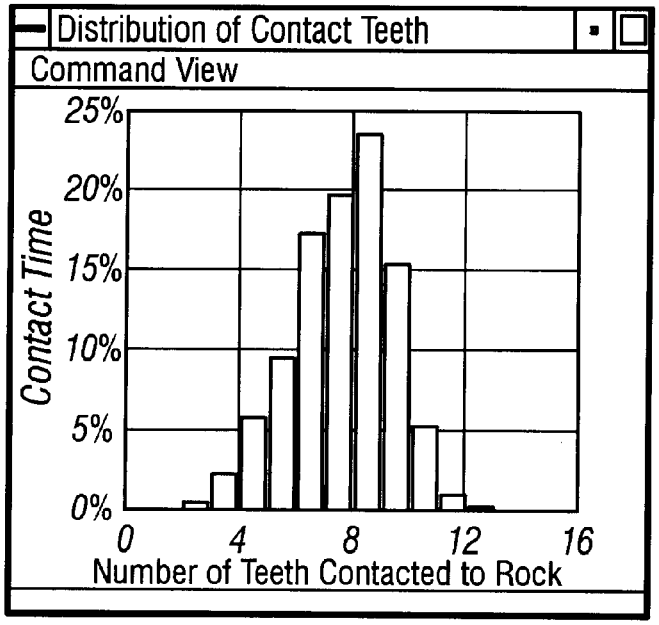
FIG. 8A (Prior Art)
FIGS. 8A–8D show a distribution of time that each of a number of cutting elements contacts a formation during drilling of a well bore for a prior art drill bit.
Figure 8B:
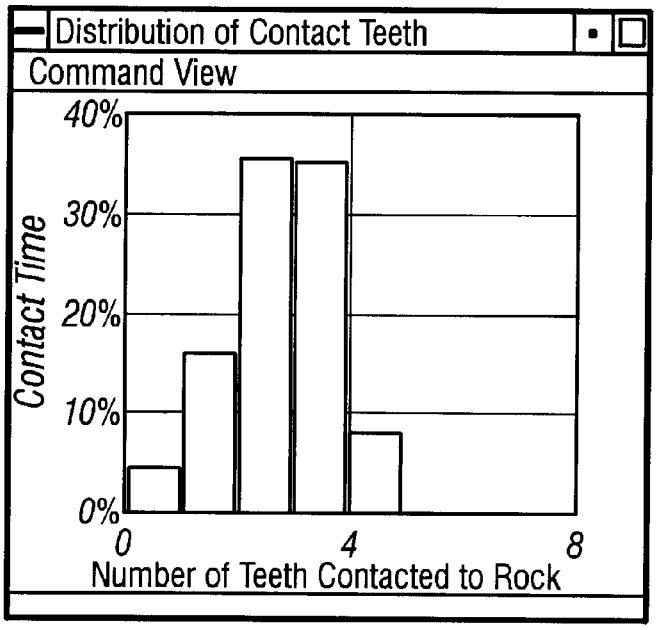
FIG. 8B (Prior Art)
Figure 8C:
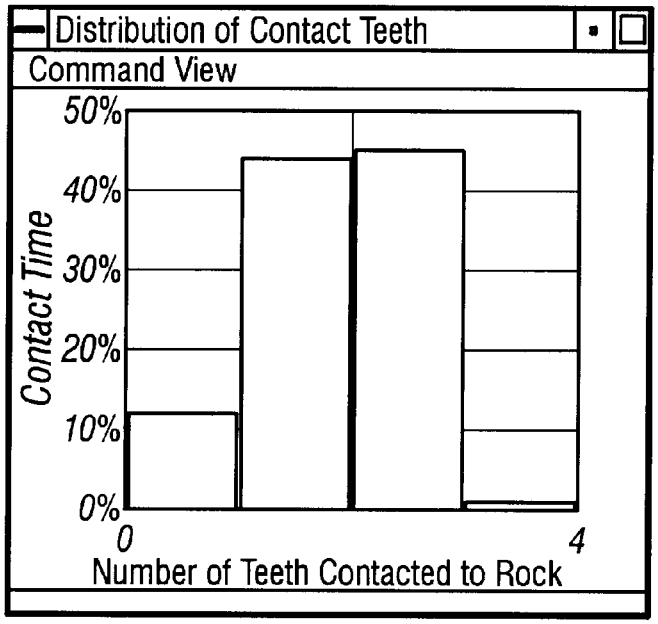
FIG. 8C (Prior Art)
Figure 8D:
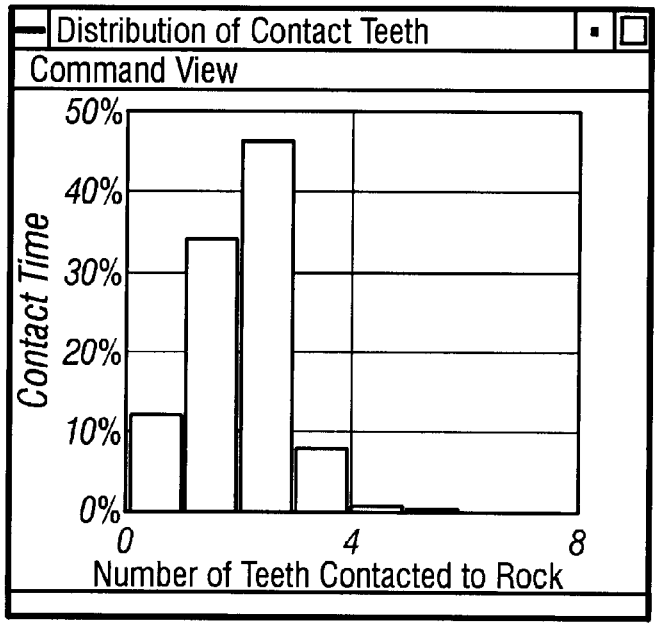
FIG. 8D (Prior Art)

Another method for determining the balance of axial force between the cones includes providing at least one operating condition sensor in a roller cone drill bit assembly to monitor the drilling performance of the bit during drilling or simulated drilling. Examples of how a roller cone drill bit can be modified to include such sensors are disclosed in U.S. Pat. No. 5,813.480 issued to Zaleski, Jr., et al., hereafter referred to as Zaleski and incorporated herein by reference. Such sensors may include strain gauges arranged within the bit body to measure strain resulting from axial force on the bit. As disclosed in Zaleski, each leg of the bit body may be equipped with strain sensors to measure axial strain, shear strain, and bending strain (see FIG. 8E of Zaleski, for example). In this embodiment of the invention, strain sensors are preferably placed proximal to the matting surface between the bit body and the cone. Alternatively, or additionally, pressure sensors may be placed proximal to the matting surface between the leg of the bit body and the cone to measure the pressure each cone exerts on the bit body during drilling. Roller cone drill bits with sensors such as described above may be subjected to simulated or actual drilling operations to determine the axial force on each cone of the bit. Additionally, different cutting element configurations can be tested using such a bit having sensors therein to find configurations which are substantially force-balanced to the degree previously explained.

Another method for determining the balance of axial force between the cones includes experimental tests involving simulated drilling using a selected drill bit on an earth formation sample. In one example, the force on each cone may be determined by placing pressure sensors on each of the cutting element of a drill bit and then rotating the drill bit on an earth formation sample with a selected axial force applied to the bit. The pressure detected at each cutting element on the bit can be recorded at discrete points in time during rotation of the bit. The axial force on each cone can then be determined by summing the axial forces on each cutting element of the cone to obtain the total force exerted by each cone during rotation of the bit. The forces on the cones can then be examined to determine the distribution of axial force between the cones.

Figure 13:
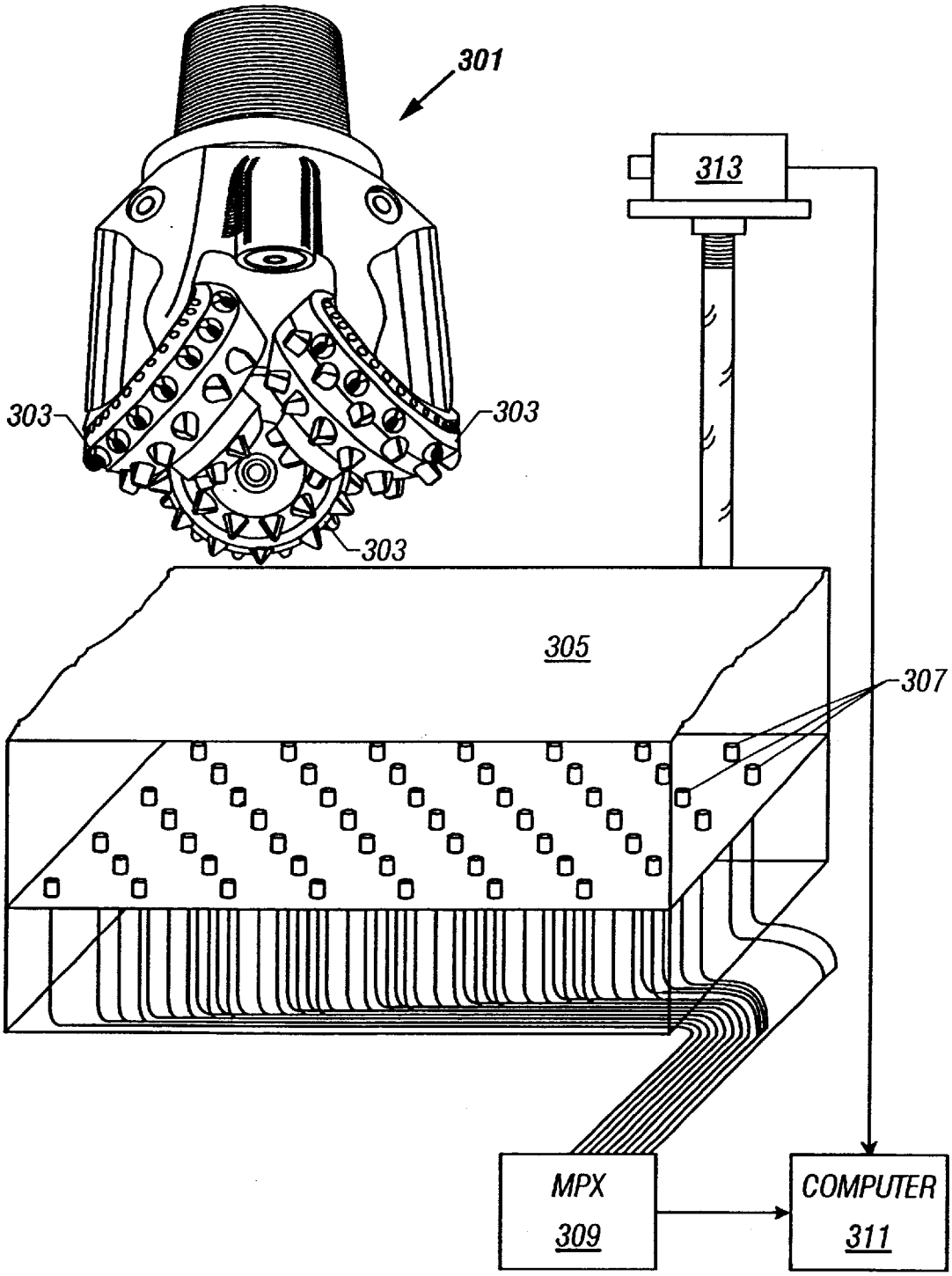
FIG. 13 shows one example of a set up for experimental tests that can be performed to determine the force on each cone of a bit during drilling.

Alternatively, the force on each cone may be determined from experimental tests involving the rotation of a selected bit on an earth formation sample having strain sensors embedded throughout the sample to measure axial strain in the sample resulting from contact with the drill bit during rotation of the bit. One example of this is shown in FIG. 13, wherein a drill bit 301 is rotated on an earth formation sample 305 with a selected axial force. In this example, the drill bit 301 includes three roller cones 303. The formation sample 305 includes a plurality of strain sensors 307 embedded throughout the sample 305 at positions distributed about the cross sectional area of the sample 305. The strain sensors 307 are used to obtain a discretized profile of axial strain in the formation being drilled. Data are collected from each of the strain sensors 307 at discrete points in time and sent to a computer 311 through a multiplexer (MPX) 309. Proximal to the drill bit 301 is a rotary orientation sensor 313 for detecting the rotary orientation of the bit 301 at any point in time. Data from the rotary orientation sensor 313 are collected at discrete points in time corresponding to the collection of the strain profiles of the formation sample 305. Drill bit orientation data obtained by the rotary orientation sensor 313 and the corresponding strain profiles obtained from the strain sensors 307 are stored in the computer 311 for discrete points in time during which the bit 301 is rotated. Once the bit 301 has been rotated a selected amount, typically several full rotations or more, the drill bit orientation and formation strain profile data stored in the computer 311 can be analyzed. The rotary orientation data stored in the computer 311 can be used to determine the location of each the cones 303 at each discrete point in time. From the determined orientation of the cones 303 on the formation sample 305 and the corresponding distribution of axial strain in the formation sample 305, the axial strain attributed to each cone can be determined. The axial strain in the formation can be approximated as proportional to the axial force on the formation. The distribution of axial strain can therefore be used as an indicator of the distribution of axial force between the cones. If desired, the axial force on each cone can be calculated from the axial strain attributed to each cone and the mechanical properties of the formation sample.

The above description provides only a few examples of methods that can be used to determine the distribution of force between cones. It should be understood that this aspect of the invention is not limited to the use of the disclosed methods for determining the balance of axial force between the cones. Other methods exist and may be used as determined by the bit designer without departing from this aspect of the invention.

Advantageously, configuring the cutting elements such that the axial forces on the bit are substantially balanced more evenly distributes the work, stress, strain, and wear on the bit between the cones of the bit, thereby potentially increasing the drilling performance and longevity of the bit. More evenly distributing the forces between the cones may also result in a reduced resulting bending moment on the bit during drilling.

The number of cutting elements and the arrangement of cutting elements may be different than that shown for the previous embodiment while still providing a substantial balance between axial forces on each cone. For example, the spacing of the cutting elements may differ, or the numbers of cutting elements may differ, or the arrangement of cutting elements may differ from that shown in the previous embodiment while still maintaining a substantial balance of axial force between the cones. It should be understood that such additional characteristics of the bit are merely a matter of choice for the bit designer, and are not intended as a limitation on this aspect of the invention. Additional embodiments in accordance with this aspect of the invention may be developed using a simulation method, such as the one mentioned in the Background section herein, or experimental models, experimental tests, or mathematical models as determined by the system designer.

Work Performed by the Bit Substantially Balanced Between the Cones

In another aspect, the invention comprises a roller cone bit having a bit body and a plurality of roller cones attached to the bit body and able to rotate with respect to the bit body. The bit further includes a plurality of cutting elements arranged on each cone so that cutting elements on adjacent cones intermesh between the cones; the cutting elements being arranged such that work performed by the bit during drilling is substantially balanced between the cones. In one embodiment, the invention provides a bit structure wherein the work performed by each cone differs by less than about 30% from that of the other cones. In a preferred embodiment, the invention provides bit structure wherein the work performed by each cone differs by less than about 20%. In a more preferred embodiment, the invention provides a bit cutting structure wherein the work performed by each cone differs by less than about 10%. Embodiments in accordance with this aspect of the invention will provide a significant improvement over the prior art bits, in that the work performed by the cones of prior art bits typically differ by 75% or more. Advantageously, balancing the work performed by the cones equalizes the drilling contribution of each cone, which may more evenly balance wear on the bit between the cones, and, thereby, increase the rate of penetration and longevity of the bit.

The term "work" used to describe this aspect of the invention is defined as follows. A cutting element in the drill bit during drilling cuts earth formation through a combination of axial penetration and lateral scraping. The movement of the cutting element through the formation can thus be separated into a lateral scraping component and an axial "crushing" component. The distance that the cutting element moves laterally, that is, in the plane of the bottom of the wellbore is called the lateral displacement. The distance that the cutting element moves in the axial direction is called the vertical displacement. The force vector acting on the cutting element can also be characterized by a lateral force component acting in the plane of the bottom of the wellbore and a vertical force component acting along the axis of the drill bit. The work done by a cutting element is defined as the product of the force required to move the cutting element, and the displacement of the cutting element in the direction of the force. Thus, the lateral work done by the cutting element is the product of the lateral force and the lateral displacement. Similarly, the vertical (axial) work done is the product of the vertical force and the vertical displacement. The total work done by each cutting element can be calculated by summing the vertical work and the lateral work. Summing the total work done by each cutting element on any one cone will provide the total work done by that cone. In this aspect of the invention, the numbers of, and/or placement or other aspect of the arrangement of the cutting elements on each cone can be adjusted to provide the drill bit with a substantially balanced amount of work performed by each cone.

One method for determining the axial force, the lateral force and the corresponding distances traveled through the formation by each cutting element is disclosed in the previously referred to U.S. patent application Ser. No. 09/524,088 (filed in the United States on Mar. 13, 2000, entitled "Method for Simulating the Drilling of Roller Cone Drill Bits and its Application to Roller Cone Drill Bit Design and Performance"). More specifically, the action of drilling by a drill bit through a selected earth formation is simulated. The forces and distances are determined by the simulation and can be summed for each cutting element on each cone to calculate the total work performed by each cone.

The number of cutting elements and the arrangement of the cutting elements may differ from that shown for the first embodiment without departing from this aspect of the invention. For example, the spacing of the cutting elements may differ from that shown for the first embodiment. If arranged in rows, the number of cutting elements on each row or the number of rows may differ from that shown in the first embodiment. Further, it should be understood that this aspect of the invention does not require that axial force on the bit be substantially balanced between the cones in this aspect of the invention. It should be understood that such additional characteristics of the bit are merely a matter of choice for the bit designer, and are not intended as a limitation on this aspect of the invention. Additional embodiments in accordance with this aspect of the invention may be developed using a simulation method, such as the one mentioned in the Background section herein, or experimental models, experimental tests, or mathematical models as determined by the system designer.

Number of Cutting Elements in Contact with Formation Substantially Balanced Between the Cones In another aspect, the invention comprises a roller cone bit having a bit body and a plurality of roller cones attached to the bit body and able to rotate with respect to the bit body. The bit further includes a plurality of cutting elements arranged on each cone so that cutting elements on adjacent cones intermesh between the cones; the cutting elements being arranged such that a distribution of time that each of a number of cutting elements contacts the earth formation during drilling is substantially the same for each of the cones. The number of cutting elements on a cone in contact with an earth formation at a given point in time is a function of, among other factors, the total number of cutting elements on the cone, the profile of the bottomhole surface, and the arrangement of the cutting elements on the cone. In one embodiment of this aspect of the invention, the cutting elements are disposed on each cone such that a fraction of time each of a number of cutting elements on each cone contacts the formation during drilling is substantially the same for each of the cones, preferably with less than about a 20% difference between cones.

One example of a distribution of time that a number of cutting elements contacts an earth formation during drilling (a distribution of contact) is shown in FIGS. 9A–9D. This distribution was obtained from a simulation of the drilling performance of the bit shown in FIGS. 4–7. The performance of this bit was simulated using the method for simulating drilling as discussed in the method described in the previously referred to U.S. patent application Ser. No. 09/524,088 (filed in the United States on Mar. 13, 2000, entitled "Method for Simulating the Drilling of Roller Cone Drill Bits and its Application to Roller Cone Drill Bit Design and Performance" and assigned to the assignee of this invention). The method described in that patent application is a convenient method for determining time distribution of cutting element contact on a roller cone drill bit, but it should be understood that the method in that patent application is only one method for determining time distribution of cutting element contact. Other methods, such as plaster or clay impressions of an actual bit, or model of a bit, having a selected cutting element configuration can be used to determine time distribution of cutting element contact.

Figure 9A:
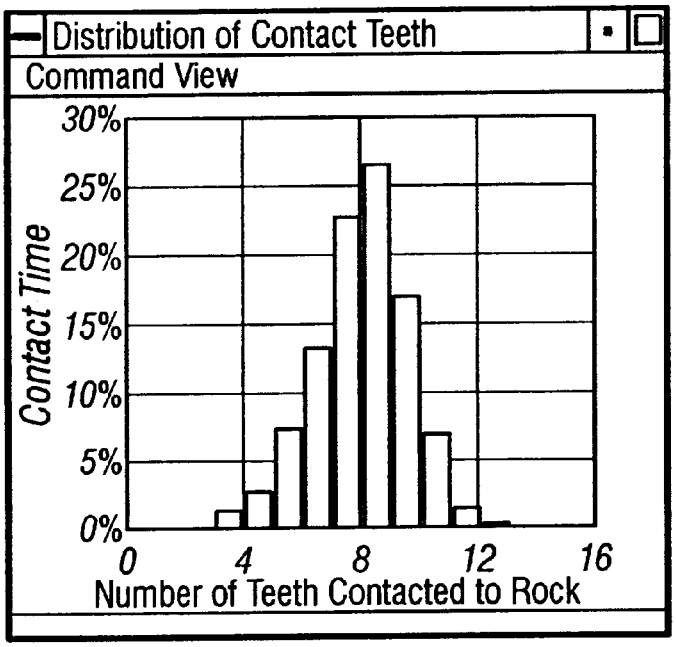
FIGS. 9A–9D show a distribution of time that each of a number of cutting elements contacts a formation during drilling of a well bore for a drill bit made in accordance with one embodiment of the invention.
Figure 9B:
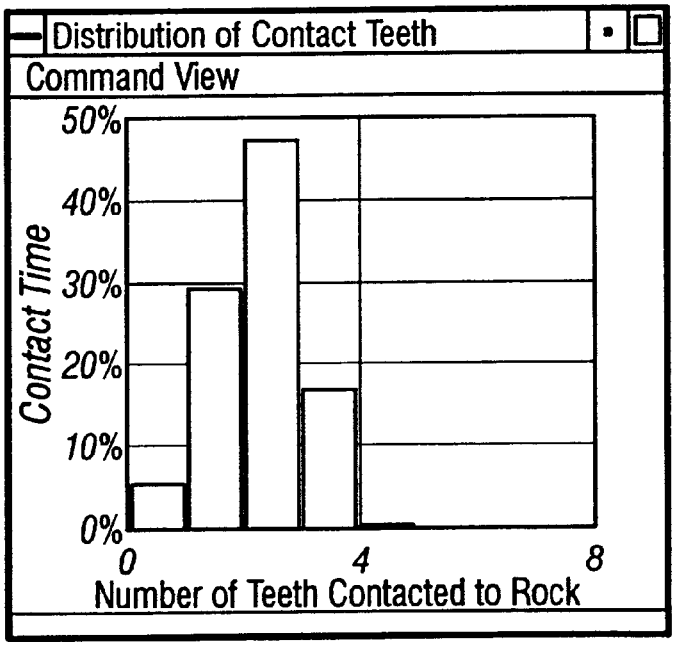
Figure 9C:
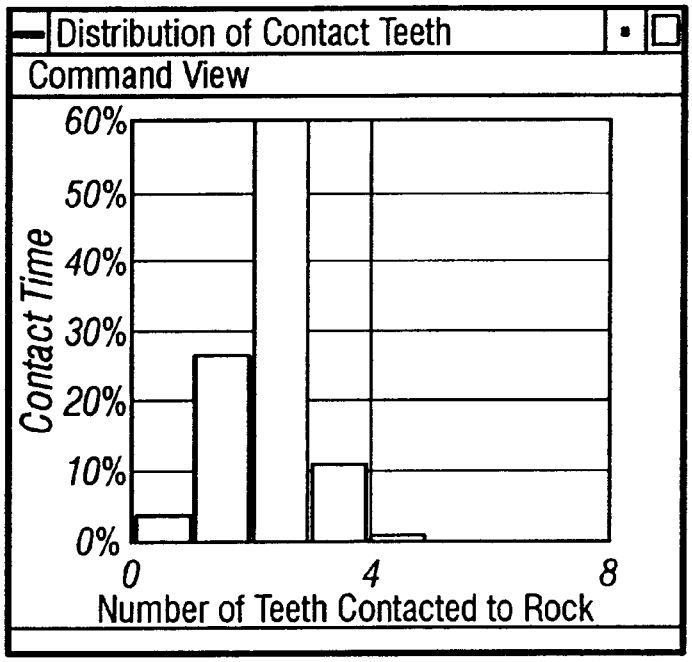
Figure 9D:
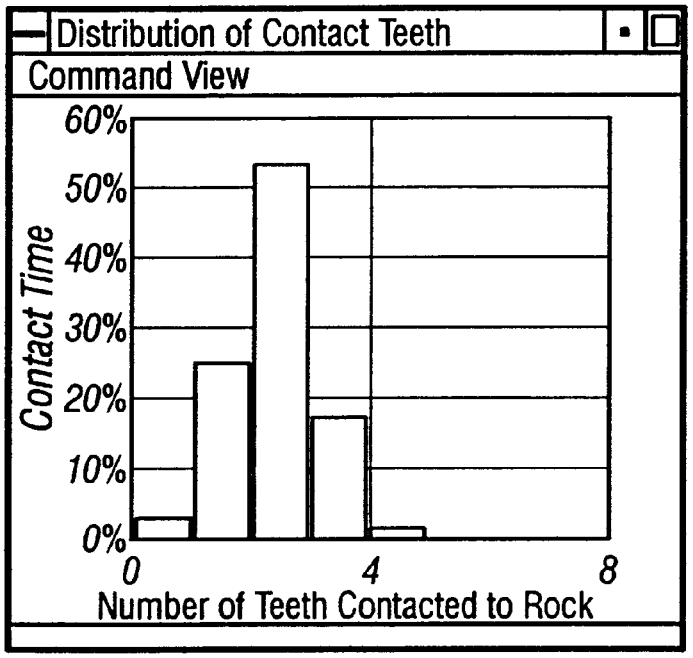

FIG. 9A shows the distribution of contact for the entire bit. FIGS. 9B, 9C, and 9D show the distribution of contact for the first, second, and third cones of the bit, respectively. Comparing the distributions of contact for each cone, it can be shown that these distributions are substantially the same. For example, the order of the number of cutting elements most frequency in contact with the formation during drilling is substantially the same for each cone. Specifically, in this example, each cone has three cutting elements in contact with the formation the greatest amount of the time, two cutting elements in contact the second greatest amount of time, four cutting elements in contact the third greatest amount of time, one cutting element in contact the fourth greatest amount of time, and five cutting elements in contact the fifth greatest amount of time. Further, for example, each cone has three or more cutting elements in contact with the formation the majority of the time, wherein the first, second, and third cones have three or more cutting elements in contact approximately 60%, 70% and 70% of the time, respectively. Additionally, the average number of cutting elements in contact with the formation is substantially the same for each of the cones, wherein the first, second, and third cones have average cutting element contacts of approximately 2.8, 2.7, and 2.9, respectively. It should also be noted that the distributions of contact for each cone (FIGS. 9B–9D) generally resembles the distribution of contact for the entire bit (FIG. 9A). Further, the fraction of the time that any given number of cutting elements contacts the formation during drilling differs by 15% or less between the cones. In the embodiment shown in FIGS. 9A–9D, the largest difference in the fraction of time for a given number of cutting elements is approximately 10%. Accordingly, the contribution of each cone to the total number of cutting elements in contact with the formation is substantially the same.

Comparing the distribution of contact for an embodiment in accordance with this aspect of the invention (FIGS. 9A–9D) and a typical prior art bit (FIGS. 8A–8D), it can be seen that although the distributions of contact for the bits are similar (FIG. 8A and FIG. 9A), the distributions of the cones significantly differ (FIGS. 8B–8D and FIGS. 9B–9D). For example, from FIGS. 8B–8D it can be seen that the first, second, and third cones of the prior art bit have three or more cutting elements in contact with the formation approximately 70%, 45%, and 55% of the time, respectively, whereas from FIGS. 9B–9D it can be seen that the first, second and third cones of the bit in accordance with this aspect of the invention have three or more cutting elements in contact with the formation approximately 60%, 70%, and 70% of the time, respectively. In this way it can be shown that the distribution of contact for the bit in accordance with this aspect of the invention is more balanced between the cones than the distribution of contact for the prior art bit. Additionally, the largest difference in the average number of cutting elements in contact with the formation during drilling was found to be 0.95 cutting elements between the cones of the prior art bit, whereas the largest difference in between the cones of FIGS. 9B–9D was only 0.2 cutting elements. Thus, advantageously, this aspect of the invention provides a cutting structure for a roller cone bit which more equally distributes cutting element contact with the formation between the cones. Advantageously, balancing the number of cutting elements in contact with the formation between the cones, may result in more even wear of the cones and longevity of the bit.

It should be understood that although the cutting elements in the embodiment disclosed herein comprises milled steel teeth, the cutting elements in this aspect of the invention are not limited to milled steel teeth. Further, it should be understood that the number of cutting elements and the arrangements of the cutting elements may be different than that shown for the first embodiment as determined by one skilled in the art, without departing from the spirit of this aspect of the invention. For example, if the cutting elements are arranged in rows, the number of cutting elements on each row may differ from the numbers shown in the first embodiment. Thus, the distributions of contact for the bit and cones may differ from that shown in FIGS. 9A–9D. Additionally, it is not required that axial force on the bit be substantially balanced between the cones in this aspect of the invention. It should be understood that such additional characteristics of the bit are merely a matter of choice for the bit designer, and are not intended as a limitation on this aspect of the invention. Additional embodiments in accordance with this aspect of the invention may be developed using a simulation method, such as the one mentioned in the Background section herein, or experimental models, experimental tests, or mathematical models as determined by the system designer.

Projected Area of Contact with Formation Substantially Balanced Between Cones

In another aspect, the invention comprises a roller cone bit having a bit body and a plurality of roller cones attached to the bit body and able to rotate with respect to the bit body. The bit further includes a plurality of cutting elements arranged on each cone so that cutting elements on adjacent cones intermesh between the cones; the cutting elements being arranged such that a projected area of the cutting elements in contact with the earth formation during drilling is substantially the same for each of the cones.

Advantageously, a roller cone drill bit having cutting elements disposed on the cones such that the projected area of cutting elements in contact with the formation for each cone is substantially the same, can result in a more equal distribution of cutting element contact between the cones of the bit. A roller cone bit made in accordance with this embodiment may also result in a more even distribution of forces between the cutting elements and between the cones.

The number of cutting elements and the arrangement of the cutting elements may be different than that shown for the first embodiment without departing from this aspect of the invention. For example, the number of cutting elements on each cone may differ from that shown for the first embodiment without departing from this aspect of the invention. If arranged in rows, the number of cutting elements on each row may differ from the numbers shown in the first embodiment. Further, the number of cutting elements on each cone in contact with the formation may be substantially different while still maintaining a substantially balanced projected area of contact between the cones. Additionally, the axial force on the bit may not be substantially balanced between the cones in this aspect of the invention. It should be understood that such additional characteristics of the bit are merely a matter of choice for the bit designer, and are not intended as a limitation on this aspect of the invention. Additional embodiments in accordance with this aspect of the invention may be developed using a simulation method, such as the one mentioned in the Background section herein, or experimental models, experimental tests, or mathematical models as determined by the system designer.

Depth of Penetration Substantially Balanced Between Cones

In another aspect, the invention comprises a roller cone bit having a bit body and a plurality of roller cones attached to the bit body and able to rotate with respect to the bit body. The bit further includes a plurality of cutting elements arranged on each cone so that cutting elements on adjacent cones intermesh between the cones; the cutting elements being arranged such that a penetration depth of each cutting element is substantially the same for each of the cones.

The cutting elements may be arranged in a different pattern than that shown for the first embodiment. For example, the spacing of the cutting elements may differ from those disclosed for the first embodiment. The number of cutting elements on each row may differ from the numbers shown in the first embodiment. Additionally, this aspect does not require that the bit exhibit axial forces substantially balanced between the cones in this aspect of the invention. It should be understood that such additional characteristics are a matter of design choice for the bit designer and are not a limitation on this aspect of the invention. Additional embodiments in accordance with this aspect of the invention may be developed, for example, using a simulation method, such as the method described in the previously referred to U.S. patent application Ser. No. 09/524,088 (filed in the United States on Mar. 13, 2000, entitled "Method for Simulating the Drilling of Roller Cone Drill Bits and its Application to Roller Cone Drill Bit Design and Performance" and assigned to the assignee of this invention). Alternatively, physical models of the bit, used to make clay or plaster impressions or the like may be used to design a roller cone bit according to this aspect of the invention.

Otimized Distribution of Force on the Bit

Figure 10:
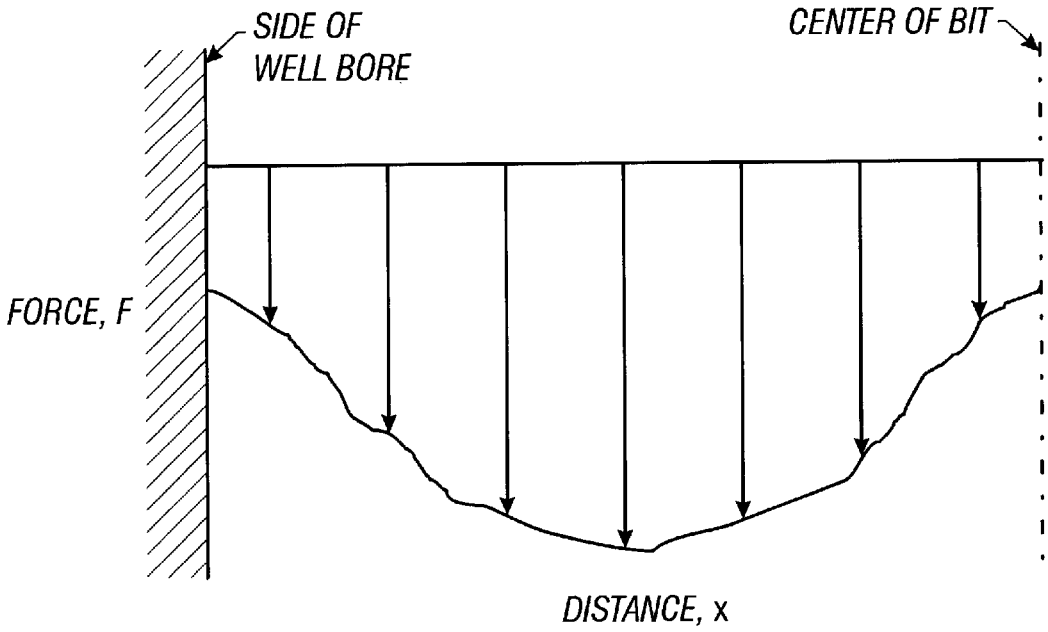
FIG. 10 shows one example of a unimodal distribution of force for a drill bit in accordance with one embodiment of the invention.
Figure 11:
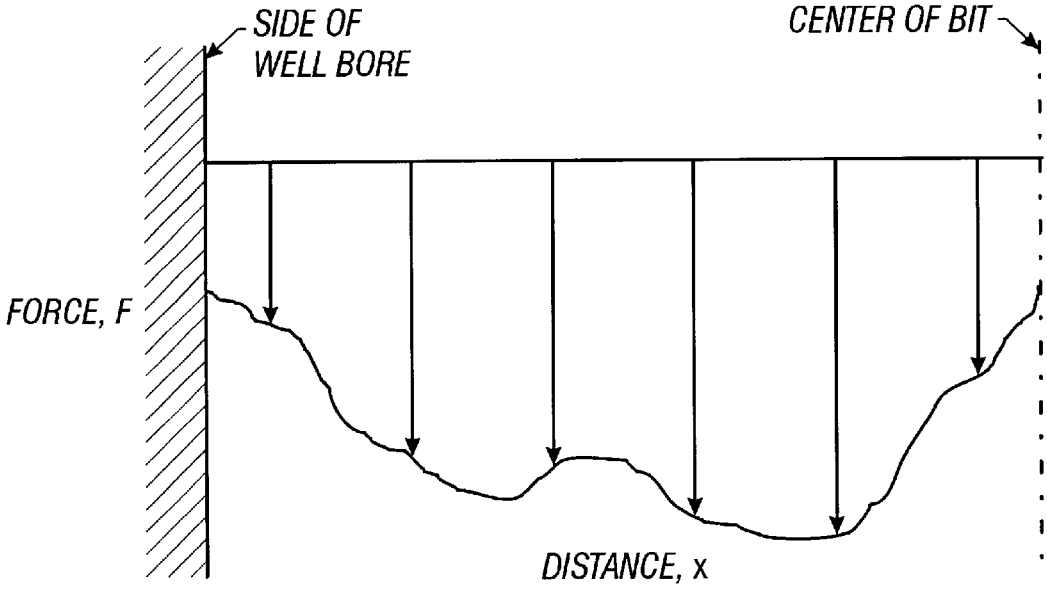
FIG. 11 (Prior Art)
FIG. 11 shows one example of a multi-modal distribution of force for a prior art drill bit.

In another aspect, the invention comprises a roller cone bit having a bit body and a plurality of roller cones attached to the bit body and able to rotate with respect to the bit body. The bit further includes a plurality of cutting elements arranged on each cone so that cutting elements on adjacent cones intermesh between the cones; the cutting elements being arranged such that the distribution of the force on each cone is optimized. In one embodiment, the cutting elements are disposed in rows, and the distribution of force is optimized between the rows on each cone such that the distribution of force on the bit is substantially unimodal. One example of a unimodal distribution of force on a drill bit in accordance with this aspect of the invention is shown in FIG. 10. In FIG. 10, the magnitude of the force on the cone is indicated by the length of a force vector, and the distribution of force is plotted with respect to the distance from the center of the bit. In contrast, the distribution of force on prior art bits is typically multi-modal. One example of a multi-modal distribution of force on a prior art bit is shown in FIG. 11.

Figure 12:
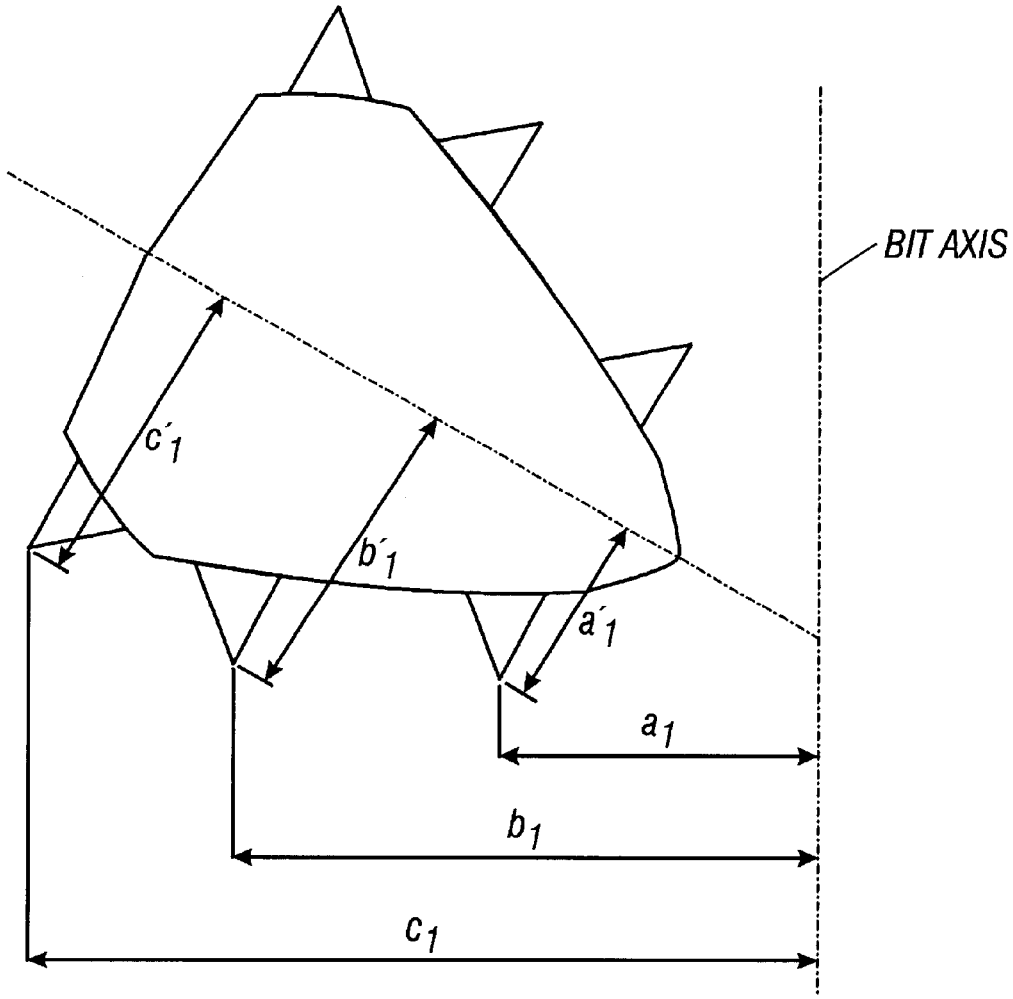
FIG. 12 shows one example of a roller cone bit wherein the location of a row of cutting elements is measured in terms of the distance of the cutting element from the bit axis and the cone axis.

In another embodiment, the cutting elements are disposed on each cone in rows, and the distribution of force on each cone is optimized with respect to the distribution of force on the other cones such that the forces on rows on each cone in a particular location on the cone are substantially the same as the forces on the corresponding rows of the other cones. The forces on corresponding rows of the cones, preferably, have a maximum difference of about 50%. The location of each row on a cone may be defined in terms of its distance from the bit axis and cone axis as shown in FIG. 12, or in any other suitable terms as determined by the bit designer. A drill bit in accordance with this embodiment may have a gage row on each cone, such that the forces on the gage row on each cone are substantially equal to within about 50% of each other. A drill bit in accordance with this embodiment may have a drive row on each cone, such that the forces on the drive row on each cone are substantially equal to within about 50% of each other. A drill bit in accordance with this embodiment may have one or more interior rows (rows located a smaller axial distance from the apex of the cone than the gage row and/or drive row) on each cone, such that the forces on each interior row on each cone are substantially equal to within about 50% of each other. In a more preferred embodiment, the forces on respective rows on the cones balance to within about 25% of each other.

In another embodiment, the cutting elements are disposed on the cones such that axial force on each cutting element on one cone is substantially the same as the axial force on each corresponding cutting element on each of the other cones, preferably, to within a maximum difference of about 50%. The location of each cutting element on a cone may be defined in terms of its distance from the bit axis and cone axis, similar to that shown in FIG. 12, or in other terms as determined by the bit designer. In a more preferred embodiment, the forces on corresponding cutting elements on the cones balance to within about 25% of each other.

Advantageously, a roller cone drill bit having cutting elements disposed on the cones, such that the distribution of the force on each cone is optimized, may provide a more balanced distribution of force between the cones, as well as on each cone of the bit. Advantageously, balancing the distribution of force between the cones may result in faster penetration and increased longevity for the bit. A drill bit in accordance with this aspect of the invention may also result in a more even distribution of forces between the cutting elements and between cones, as well as a more uniform drilling of the bottomhole surface.

The number of cutting elements and the arrangement of the cutting elements may be different than that shown for the first embodiment, while still maintaining an optimized distribution of force on the cones. It should be understood that having additional characteristics of the bit in accordance with previous aspects of the invention is merely a matter of choice for the bit designer, and is not intended as a limitation on this aspect of the invention. Additional embodiments in accordance with this aspect of the invention may be developed using, for example the method described in the previously referred to U.S. patent application Ser. No. 09/524,088 (filed in the United States on Mar. 13, 2000, entitled "Method for Simulating the Drilling of Roller Cone Drill Bits and its Application to Roller Cone Drill Bit Design and Performance" and assigned to the assignee of this invention). Other methods for determining force distribution could include strain gauge measurements in an instrumented physical model of the bit, or in an instrumented physical model of a formation adapted to measure the distribution of force across the profile of the drill bit.

The invention has been described with respect to preferred embodiments. Different embodiments of the invention may provide different advantages, as described above. While embodiments of the invention may include one or more of these advantages, the invention is not limited to these advantages. It will be apparent to those skilled in the art that the foregoing description is only an example of the invention, and that other embodiments of the invention can be devised which will not depart from the spirit of the invention as disclosed herein. Accordingly, the invention shall be limited in scope only by the attached claims.

What is claimed is:

1. A roller cone drill bit for drilling a formation, comprising:

a bit body;

three roller cones attached to said bit body and able to rotate with respect to said bit body; and a plurality of cutting elements arranged on each of the cones so that cutting elements on adjacent cones intermesh between the adjacent cones, the cutting elements being arranged such that a distribution of a number of cutting elements contacting the formation during drilling is substantially the same for each of the cones.

2. The drill bit according to claim 1, wherein a fraction of a total time any number of cutting elements on each cone contacts the formation differs by less than about 20% from the fraction of the other cones.

3. The drill bit according to claim 1, wherein axial force exerted on the bit during drilling is substantially balanced between the cones.

4. The drill bit according to claim 3, wherein said axial force on the bit is balanced within about 25% between cones.

5. The drill bit according to claim 3, wherein said axial force on the bit is balanced within about 10% between cones.

6. The drill bit according to claim 3, where said axial force on the bit is balanced between the cones in a ratio of about 1.09, 1, and 1.03.

7. The drill bit according to claim 1, wherein said cutting elements are disposed on each cone, such that work performed by each cone during drilling is substantially the same as the work performed by each of the other cones.

8. The drill bit according to claim 7, wherein the work performed by each cone differs by less than about 30% from the work performed by each of the other cones.

9. The drill bit according to claim 7, wherein the work performed by each cone differs by less than about 20% from the work performed by each of the other cones.

10. The drill bit according to claim 7, wherein the work performed by each cone differs by less than about 10% from the work performed by each of the other cones.

11. The drill bit according to claim 7, wherein the cones have volume of formation cutting ratios of about 1.02, 1, and 1.08.

12. The drill bit according to claim 1, wherein a projected area of said cutting elements in contact with a formation during drilling is substantially the same for each of the cones.

13. The drill bit according to claim 1, wherein a depth of penetration for each cutting element into a formation during drilling is substantially the same for each of the cones.

14. The drill bit according to claim 1, wherein a distribution of axial force on the bit is optimized.

15. The drill bit according to claim 14, wherein the cutting elements are disposed in rows on each of the cones so that the distribution of axial force on the bit is substantially unimodal.

16. The drill bit according to claim 14, wherein the cutting elements are disposed in rows on each of the cones so that axial forces on corresponding rows on each cone are substantially the same.

17. The drill bit according to claim 16, wherein axial forces on corresponding rows balance to within about 50%.

18. The drill bit according to claim 16, wherein axial forces on corresponding rows balance to within about 25%.

19. The drill bit according to claim 14, wherein axial force on each cutting element on one cone is substantially the same as axial force on each corresponding cutting element on each of the other cones.

20. The drill bit according to claim 19, wherein axial force on cutting elements on each cone is within about 50% of the axial force on the corresponding cutting elements on each of the other cones.

21. The drill bit according to claim 19, wherein axial force on cutting elements on each cone is within about 25% of the axial force on the corresponding cutting elements on each of the other cones.

22. The drill bit according to claim 1, wherein said cutting elements comprise superhard inserts.

23. The drill bit according to claim 22, wherein said superhard inserts comprise boron nitride.

24. The drill bit according to claim 22, wherein said superhard inserts comprise polycrystalline diamond compacts.

25. The drill bit according to claim 1, wherein said cutting elements comprise tungsten carbide inserts.

26. The drill bit according to claim 25, wherein said cutting elements further comprise a superhard material coating.

27. The drill bit according to claim 1, wherein said cutting elements comprise milled steel teeth.

28. The drill bit according to claim 27, wherein said cutting elements further comprise hardface coating.

29. A roller cone drill bit, comprising:

a bit body;

three roller cones attached to said bit body and able to rotate with respect to said bit body;

a plurality of cutting elements arranged on each of the cones so that cutting elements on adjacent cones intermesh between the adjacent cones, the cutting elements being arranged such that a projected area of said cutting elements in contact with a formation during drilling is substantially the same for each of the cones.

30. The drill bit according to claim 29, wherein axial force exerted on the bit during drilling is substantially balanced between the cones.

31. The drill bit according to claim 30, wherein said axial force on the bit is balanced within about 25% between cones.

32. The drill bit according to claim 30, wherein said axial force on the bit is balanced within about 10% between cones.

33. The drill bit according to claim 30, where said axial force on the bit is balanced between the cones in a ratio of about 1.09, 1, and 1.03.

34. The drill bit according to claim 29, wherein said cutting elements are disposed on each cone, such that work performed by each cone during drilling is substantially the same as the work performed each of the other cones.

35. The drill bit according to claim 34, wherein the work performed by each cone differs by less than about 30% from the work performed by each of the other cones.

36. The drill bit according to claim 34, wherein the work performed by each cone differs by less than about 20% from the work performed by each of the other cones.

37. The drill bit according to claim 34, wherein the work performed by each cone differs by less than about 10% from the work performed by each of the other cones.

38. The drill bit according to claim 34, wherein the cones have volume of formation cutting ratios of about 1.02, 1, and 1.08.

39. The drill bit according to claim 29, wherein a distribution of time that each of a number of cutting elements contacts the formation during drilling thereof is substantially the same for each of the cones.

40. The drill bit according to claim 39, wherein a fraction of a total time any number of cutting elements on each cone contacts the formation differs by less than about 20% from the fraction of the other cones.

41. The drill bit according to claim 29, wherein a depth of penetration for each cutting element into a formation during drilling is substantially the same for each of the cones.

42. The drill bit according to claim 29, wherein a distribution of axial force on the bit is optimized.

43. The drill bit according to claim 42, wherein the cutting elements are disposed in rows on each of the cones so that the distribution of axial force on the bit is substantially unimodal.

44. The drill bit according to claim 42, wherein the cutting elements are disposed in rows on each of the cones so that axial forces on corresponding rows on each cone are substantially the same.

45. The drill bit according to claim 44, wherein axial forces on corresponding rows balance to within about 50%.

46. The drill bit according to claim 44, wherein axial forces on corresponding rows balance to within about 25%.

47. The drill bit according to claim 42, wherein axial force on each cutting element on one cone is substantially the same as axial force on each corresponding cutting element on each of the other cones.

48. The drill bit according to claim 47, wherein axial force on cutting elements on each cone is within about 50% of the axial force on the corresponding cutting elements on each of the other cones.

49. The drill bit according to claim 47, wherein axial force on cutting elements on each cone is within about 25% of the axial force on the corresponding cutting elements on each of the other cones.

50. The drill bit according to claim 29, wherein said cutting elements comprise superhard inserts.

51. The drill bit according to claim 50, wherein said superhard inserts comprise boron nitride.

52. The drill bit according to claim 50, wherein said superhard inserts comprise polycrystalline diamond compacts.

53. The drill bit according to claim 29, wherein said cutting elements comprise tungsten carbide inserts.

54. The drill bit according to claim 53, wherein said cutting elements further comprise a superhard material coating.

55. The drill bit according to claim 29, wherein said cutting elements comprise milled steel teeth.

56. The drill bit according to claim 55, wherein said cutting elements further comprise hardface coating.

57. A roller cone drill bit, comprising:

a bit body;

three roller cones attached to said bit body and able to rotate with respect to said bit body;

a plurality of cutting elements arranged on each of the cones so that cutting elements on adjacent cones intermesh between the adjacent cones, the cutting elements being arranged such that a depth of penetration for the cutting elements into a formation during drilling is substantially the same for each of the cones.

58. The drill bit according to claim 57, wherein axial force exerted on the bit during drilling is substantially balanced between the cones.

59. The drill bit according to claim 58, wherein said axial force on the bit is balanced within about 25% between cones.

60. The drill bit according to claim 58, wherein said axial force on the bit is balanced within about 10% between cones.

61. The drill bit according to claim 58, where said axial force on the bit is balanced between the cones in a ratio of about 1.09, 1, and 1.03.

62. The drill bit according to claim 57, wherein said cutting elements are disposed on each cone, such that work performed by each cone during drilling is substantially the same as the work performed by each of the other cones.

63. The drill bit according to claim 62, wherein the work performed by each cone differs by less than about 30% from the work performed by each of the other cone.

64. The drill bit according to claim 62, wherein the work performed by each cone differs by less than about 20% from the work performed by each of the other cones.

65. The drill bit according to claim 62, wherein the work performed by each cone differs by less than about 10% from the work performed by each of the other cones.

66. The drill bit according to claim 62, wherein the cones have volume of formation cutting ratios of about 1.02, 1, and 1.08.

67. The drill bit according to claim 57, wherein a distribution of time that each of a number of cutting elements contacts the formation during drilling thereof is substantially the same for each of the cones.

68. The drill bit according to claim 67, wherein a fraction of a total time any number of cutting elements on each cone contacts the formation differs by less than about 20% from the fraction of the other cones.

69. The drill bit according to claim 68, wherein axial force on each cutting element on one cone is substantially the same as axial force on each corresponding cutting element on each of the other cones.

70. The drill bit according to claim 69, wherein axial force on cutting elements on each cone is within about 50% of the axial force on the corresponding cutting elements on each of the other cones.

71. The drill bit according to claim 69, wherein axial force on cutting elements on each cone is within about 25% of the axial force on the corresponding cutting elements on each of the other cones.

72. The drill bit according to claim 57, wherein a projected area of said cutting elements in contact with a formation during drilling is substantially the same for each of the cones.

73. The drill bit according to claim 57, wherein a distribution of axial force on the bit is optimized.

74. The drill bit according to claim 73, wherein the cutting elements are disposed in rows on each of the cones so that the distribution of axial force on the bit is substantially unimodal.

75. The drill bit according to claim 73, wherein the cutting elements are disposed in rows on each of the cones so that axial forces on corresponding rows on each cone are substantially the same.

76. The drill bit according to claim 75, wherein axial forces on corresponding rows balance to within about 50%.

77. The drill bit according to claim 75, wherein axial forces on corresponding rows balance to within about 25%.

78. The drill bit according to claim 57, wherein said cutting elements comprise superhard inserts.

79. The drill bit according to claim 78, wherein said superhard inserts comprise boron nitride.

80. The drill bit according to claim 78, wherein said superhard inserts comprise polycrystalline diamond compacts.

81. The drill bit according to claim 57, wherein said cutting elements comprise tungsten carbide inserts.

82. The drill bit according to claim 81, wherein said cutting elements further comprise a superhard material coating.

83. The drill bit according to claim 57, wherein said cutting elements comprise milled steel teeth.

84. The drill bit according to claim 83, wherein said cutting elements further comprise hardface coating.

85. A roller cone drill bit, comprising:

a bit body;

three roller cones attached to said bit body and able to rotate with respect to said bit body;

a plurality of cutting elements arranged on each of the cones so that cutting elements on adjacent cones intermesh between the adjacent cones, the cutting elements being arranged such that a distribution of axial force on the bit is optimized, wherein the cutting elements are disposed in rows on each of the cones so that the distribution of axial force on the bit is substantially unimodal.

86. The drill bit according to claim 85, wherein the cutting elements are disposed in rows on each of the cones so that axial forces on corresponding rows on each cone are substantially the same.

87. The drill bit according to claim 86, wherein axial forces on corresponding rows balance to within about 50%.

88. The drill bit according to claim 86, wherein axial forces on corresponding rows balance to within about 25%.

89. The drill bit according to claim 85, wherein axial force on each cutting element on one cone is substantially the same as axial force on each corresponding cutting element on each of the other cones.

90. The drill bit according to claim 89, wherein axial force on cutting elements on each cone is within about 50% of the axial force on the corresponding cutting elements on each of the other cones.

91. The drill bit according to claim 89, wherein axial force on cutting elements on each cone is within about 25% of the axial force on the corresponding cutting elements on each of the other cones.

92. The drill bit according to claim 85, wherein axial force exerted on the bit during drilling is substantially balanced between the cones.

93. The drill bit according to claim 92, wherein said axial force on the bit is balanced within about 25% between cones.

94. The drill bit according to claim 92, wherein said axial force on the bit is balanced within about 10% between cones.

95. The drill bit according to claim 92, where said axial force on the bit is balanced between the cones in a ratio of about 1.09, 1, and 1.03.

96. The drill bit according to claim 85, wherein said cutting elements are disposed on each cone, such that work performed by each cone during drilling is substantially the same as the work performed by each of the other cones.

97. The drill bit according to claim 96, wherein the work performed by each cone differs by less than about 30% from the work performed by each of the other cones.

98. The drill bit according to claim 96, wherein the work performed by each cone differs by less than about 20% from the work performed by each of the other cones.

99. The drill bit according to claim 96, wherein the work performed by each cone differs by less than about 10% from the work performed by each of the other cones.

100. The drill bit according to claim 96, wherein the cones have volume of formation cutting ratios of about 1.02, 1, and 1.08.

101. The drill bit according to claim 85, wherein a distribution of time that each of a number of cutting elements contacts the formation during drilling thereof is substantially the same for each of the cones.

102. The drill bit according to claim 101, wherein a fraction of a total time any number of cutting elements on each cone contacts the formation differs by less than about 20% from the fraction of the other cones.

103. The drill bit according to claim 85, wherein a projected area of said cutting elements in contact with a formation during drilling is substantially the same for each of the cones.

104. The drill bit according to claim 85, wherein a depth of penetration for each cutting element into a formation during drilling is substantially the same for each of the cones.

105. The drill bit according to claim 85, wherein said cutting elements comprise superhard inserts.

106. The drill bit according to claim 105, wherein said superhard inserts comprise boron nitride.

107. The drill bit according to claim 105, wherein said superhard inserts comprise polycrystalline diamond compacts.

108. The drill bit according to claim 85, wherein said cutting elements comprise tungsten carbide inserts.

109. The drill bit according to claim 108, wherein said cutting elements further comprise a superhard material coating.

110. The drill bit according to claim 85, wherein said cutting elements comprise milled steel teeth.

111. The drill bit according to claim 110, wherein said cutting elements further comprise hardface coating.

* * * * *